US006624588B2

(12) United States Patent
Nakamura

(10) Patent No.: US 6,624,588 B2
(45) Date of Patent: Sep. 23, 2003

(54) METHOD OF DRIVING PLASMA DISPLAY PANEL

(75) Inventor: Hideto Nakamura, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 0 days.

(21) Appl. No.: 10/156,183

(22) Filed: May 29, 2002

(65) Prior Publication Data

US 2003/0006715 A1 Jan. 9, 2003

(30) Foreign Application Priority Data

Jun. 22, 2001 (JP) ..... 2001-189601

(51) Int. Cl.[7] ..... G09G 3/28

(52) U.S. Cl. ..... 315/169.1; 315/169.4; 345/67; 345/63

(58) Field of Search ..... 315/169.1, 169.4, 315/169.2, 169.3; 345/60–72

(56) References Cited

U.S. PATENT DOCUMENTS 5,317,334 A * 5/1994 Sano ..... 345/63
5,990,630 A * 11/1999 Nakamura ..... 315/169.4
6,175,194 B1 * 1/2001 Saegusa et al. ..... 315/169.4

FOREIGN PATENT DOCUMENTS

EP 1020838 * 7/2000

* cited by examiner

*Primary Examiner*—Don Wong
*Assistant Examiner*—Ephrem Alemu
(74) *Attorney, Agent, or Firm*—Sughrue Mion, PLLC

(57) ABSTRACT

A plasma display panel driving method which is capable of displaying a high quality image with a large number of gradation levels without erroneously discharging discharge cells. A scanning pulse and a pixel data pulse have a narrower pulse width as they are applied at an earlier time in an addressing stage in each of subfields.

6 Claims, 20 Drawing Sheets

$T_{3r} < T_{2r} < T_{1r}$ (r : NATURAL NUMBER FROM 1 TO n)

FIG. 16

| CONVERSION TABLE FOR SECOND DATA CONVERTER CIRCUIT 34 | | | | | | | | | LIGHT EMISSION PATTERN | | | | | | | | LUMINANCE |
|---|---|---|---|---|---|---|---|---|---|---|---|---|---|---|---|---|---|
| PDs | GD 1 | 2 | 3 | 4 | 5 | 6 | 7 | 8 | SF 1 | SF 2 | SF 3 | SF 4 | SF 5 | SF 6 | SF 7 | SF 8 | |
| 0000 | 1 | 1 | 1 | 1 | 1 | 1 | 1 | 1 | ● | ● | ● | ● | ● | ● | ● | ● | 0 |
| 0001 | 0 | 1 | 1 | 1 | 1 | 1 | 1 | 1 | ○ | ● | ● | ● | ● | ● | ● | ● | 1 |
| 0010 | 0 | 0 | 1 | 1 | 1 | 1 | 1 | 1 | ○ | ○ | ● | ● | ● | ● | ● | ● | 7 |
| 0011 | 0 | 0 | 0 | 1 | 1 | 1 | 1 | 1 | ○ | ○ | ○ | ● | ● | ● | ● | ● | 23 |
| 0100 | 0 | 0 | 0 | 0 | 1 | 1 | 1 | 1 | ○ | ○ | ○ | ○ | ● | ● | ● | ● | 47 |
| 0101 | 0 | 0 | 0 | 0 | 0 | 1 | 1 | 1 | ○ | ○ | ○ | ○ | ○ | ● | ● | ● | 82 |
| 0110 | 0 | 0 | 0 | 0 | 0 | 0 | 1 | 1 | ○ | ○ | ○ | ○ | ○ | ○ | ● | ● | 128 |
| 0111 | 0 | 0 | 0 | 0 | 0 | 0 | 0 | 1 | ○ | ○ | ○ | ○ | ○ | ○ | ○ | ● | 185 |
| 1000 | 0 | 0 | 0 | 0 | 0 | 0 | 0 | 0 | ○ | ○ | ○ | ○ | ○ | ○ | ○ | ○ | 255 |

BLACK CIRCLE : SELECTIVE ERASURE DISCHARGE
WHITE CIRCLE : LIGHT EMISSION BY SUSTAIN DISCHARGE

FIG. 20

| CONVERSION TABLE FOR SECOND DATA CONVERTER CIRCUIT 34 | | | | | | | | | LIGHT EMISSION PATTERN | | | | | | | | LUMINANCE |
|---|---|---|---|---|---|---|---|---|---|---|---|---|---|---|---|---|---|
| PDs | GD 1 | 2 | 3 | 4 | 5 | 6 | 7 | 8 | SF 1 | SF 2 | SF 3 | SF 4 | SF 5 | SF 6 | SF 7 | SF 8 | |
| 0000 | 1 | 0 | 0 | 0 | 0 | 0 | 0 | 0 | ● | | | | | | | | 0 |
| 0001 | 0 | 1 | 0 | 0 | 0 | 0 | 0 | 0 | ○ | ● | | | | | | | 1 |
| 0010 | 0 | 0 | 1 | 0 | 0 | 0 | 0 | 0 | ○ | ○ | ● | | | | | | 7 |
| 0011 | 0 | 0 | 0 | 1 | 0 | 0 | 0 | 0 | ○ | ○ | ○ | ● | | | | | 23 |
| 0100 | 0 | 0 | 0 | 0 | 1 | 0 | 0 | 0 | ○ | ○ | ○ | ○ | ● | | | | 47 |
| 0101 | 0 | 0 | 0 | 0 | 0 | 1 | 0 | 0 | ○ | ○ | ○ | ○ | ○ | ● | | | 82 |
| 0110 | 0 | 0 | 0 | 0 | 0 | 0 | 1 | 0 | ○ | ○ | ○ | ○ | ○ | ○ | ● | | 128 |
| 0111 | 0 | 0 | 0 | 0 | 0 | 0 | 0 | 1 | ○ | ○ | ○ | ○ | ○ | ○ | ○ | ● | 185 |
| 1000 | 0 | 0 | 0 | 0 | 0 | 0 | 0 | 0 | ○ | ○ | ○ | ○ | ○ | ○ | ○ | ○ | 255 |

BLACK CIRCLE : SELECTIVE ERASURE DISCHARGE
WHITE CIRCLE : LIGHT EMISSION BY SUSTAIN DISCHARGE

FIG. 21

| CONVERSION TABLE FOR SECOND DATA CONVERTER CIRCUIT 34 | | | | | | | | | LIGHT EMISSION PATTERN | | | | | | | | LUMINANCE |
|---|---|---|---|---|---|---|---|---|---|---|---|---|---|---|---|---|---|
| PDs | GD 1 | 2 | 3 | 4 | 5 | 6 | 7 | 8 | SF 1 | SF 2 | SF 3 | SF 4 | SF 5 | SF 6 | SF 7 | SF 8 | |
| 0000 | 1 | 1 | * | * | * | * | * | * | ● | ● | △ | △ | △ | △ | △ | △ | 0 |
| 0001 | 0 | 1 | 1 | * | * | * | * | * | ○ | ● | ● | △ | △ | △ | △ | △ | 1 |
| 0010 | 0 | 0 | 1 | 1 | * | * | * | * | ○ | ○ | ● | ● | △ | △ | △ | △ | 7 |
| 0011 | 0 | 0 | 0 | 1 | 1 | * | * | * | ○ | ○ | ○ | ● | ● | △ | △ | △ | 23 |
| 0100 | 0 | 0 | 0 | 0 | 1 | 1 | * | * | ○ | ○ | ○ | ○ | ● | ● | △ | △ | 47 |
| 0101 | 0 | 0 | 0 | 0 | 0 | 1 | 1 | * | ○ | ○ | ○ | ○ | ○ | ● | ● | △ | 82 |
| 0110 | 0 | 0 | 0 | 0 | 0 | 0 | 1 | 1 | ○ | ○ | ○ | ○ | ○ | ○ | ● | ● | 128 |
| 0111 | 0 | 0 | 0 | 0 | 0 | 0 | 0 | 1 | ○ | ○ | ○ | ○ | ○ | ○ | ○ | ● | 185 |
| 1000 | 0 | 0 | 0 | 0 | 0 | 0 | 0 | 0 | ○ | ○ | ○ | ○ | ○ | ○ | ○ | ○ | 255 |

* : "1" OR "0"

BLACK CIRCLE : SELECTIVE ERASURE DISCHARGE
WHITE CIRCLE : LIGHT EMISSION BY SUSTAIN DISCHARGE

METHOD OF DRIVING PLASMA DISPLAY PANEL

BACKGROUND OF THE INVENTION

1. Field of the Invention

The present invention relates to a method of driving a plasma display panel.

2. Description of the Related Art

In recent years, a variety of thin display devices have been brought into practical use in response to demands for thinner display devices with the trend of increase in screen sizes thereof. A plasma display panel of AC discharge type has drawn attention as one of thin display devices.

FIG. 1 is a diagram generally illustrating the configuration of a plasma display device which comprises a plasma display panel as mentioned above, and a driver for driving the plasma display panel.

In FIG. 1, a PDP 10 as a plasma display panel comprises m column electrodes $D_1$–$D_m$ as data electrodes, and n each of row electrodes $X_1$–$X_n$ and $Y_1$–$Y_n$ which are arranged to intersect with each of the column electrodes. A pair of row electrodes $X_i$ ($1 \leqq i \leqq n$) and $Y_i$ ($1 \leqq i \leqq n$) in these row electrodes $X_1$–$X_n$ and $Y_1$–$Y_n$ bear each of display lines on the PDP. These column electrodes D and row electrodes X, Y are disposed in opposition to each other with an intervening discharge space which is filled with a discharge gas, and a discharge cell carrying a pixel is formed at each of intersections of the row electrode pairs and column electrode, including this discharge space. The discharge cell can only take two states, i.e., a "lit state" and an "unlit state" because it emits light through discharge. In other words, the discharge cell only represents two levels of luminance consisting of minimum luminance (unlit state) and maximum luminance (lit state).

A driver 100 performs gradation driving based on a subfield method for the PDP 10 comprising the discharge cells as display cells carrying pixels in order to realize a halftone luminance display corresponding an input video signal. The subfield method involves dividing one field display period into a plurality of subfields, and allocating each of the subfields with a number of times light emission is performed, corresponding to weighting applied to the respective subfields. For example, one field display period is divided into four subfields SF1–SF4, as shown in FIG. 2, which are allocates with the numbers of times of light emission as follows:

SF1: 1

SF2: 2

SF3: 4

SF4: 8

Here, the driver 100 converts an input video signal to 4-bit pixel data corresponding to each pixel. A first to a fourth bit of pixel data correspond to the subfields SF1–SF4, respectively. Then, the subfield method based gradation driving causes discharge cells to emit light the aforementioned numbers of times in the subfields corresponding to the respective bit digits in accordance with a logical level of each bit of the pixel data.

FIG. 3 illustrates a variety of driving pulses applied by the driver 100 to the column electrodes and row electrode pairs of the PDP 10 in each of the subfields for performing the light emission driving as described above, and timings at which the driving pulses are applied.

First, in a simultaneous reset stage Rc shown in FIG. 3, the driver 100 simultaneously applies the row electrodes $X_1$–$X_N$ with a reset pulse $RP_X$ of positive polarity and the row electrodes $Y_1$–$Y_N$ with a reset pulse $RP_Y$ of negative polarity. In response to these reset pulses $RP_X$ and $RP_Y$, all discharge cells in the PDP 10 are discharged or reset to uniformly form a wall charge of a predetermined amount within the respective discharge cells. In this manner, all the discharge cells in the PDP 10 are once initialized to "light emitting cells."

Next, in an addressing stage Wc, the driver 100 extracts one bit corresponding to this subfield from the 4-bit pixel data as described above, and generates a pixel data pulse having a pulse voltage corresponding to the logical level of the bit. For example, in the subfield SF1, the driver 100 generates a pixel data pulse having a pulse voltage corresponding to the logical level of a first bit of the pixel data. In this event, the driver 100 generates the pixel data pulse having a high voltage pulse when the logical level of the first bit is at "1" and a low voltage (zero volt) pulse when at "0." Then, the driver 100 applies one display line of pixel data pulses sequentially to the column electrodes $D_1$–$D_m$. Specifically, as illustrated in FIG. 3, the driver 100 first applies the column electrodes $D_1$–$D_m$ with a pixel data pulse group $DP_1$ comprised of m pixel data pulses corresponding to a first display line, and next applies the column electrodes $D_1$–$D_m$ with a pixel data pulse group $DP_2$ comprised of m pixel data pulses corresponding to a second display line. Similarly, the driver 100 subsequently applies the column electrodes $D_1$–$D_m$ sequentially with pixel data pulse groups $DP_3$–$DP_n$ corresponding to a third to an n-th display line, respectively. The driver 100 further generates a scanning pulse SP of negative polarity in synchronism with the timing at which each pixel data pulse group DP is applied, and sequentially applies the scanning pulse SP to the row electrodes $Y_1$–$Y_N$, as illustrated in FIG. 3. In this event, a discharge selectively occurs only in discharge cells at intersections of the display lines applied with the scanning pulse SP with the column electrodes applied with the pixel data pulse at the high voltage (selective erasure discharge), thereby extinguishing the wall charges which have remained in these discharge cells. In this manner, the discharge cells initialized to the "lit discharge cell state" in the simultaneous reset stage Rc transitions to the "unlit discharge cell state." On the other hand, the selective erasure discharge is not generated in discharge cells which have been applied with the pixel data pulse at the low voltage simultaneously with the scanning pulse SP, so that these cells maintain the state initialized in the simultaneous reset stage Rc, i.e., "lit discharge cell state."

In other words, the addressing stage Wc is executed to set each of the discharge cells in the PDP 10 either to the "lit discharge cell state" or to the "unlit discharge cell state" in accordance with the pixel data corresponding to the input video signal.

Next, in a light emission sustain stage Ic, the driver 100 alternately applies the row electrodes $X_1$–$X_n$ and $Y_1$–$Y_n$ with sustain pulses $IP_X$ and $IP_Y$ of positive polarity as illustrated in FIG. 3, the number of times allocated to each subfield as mentioned above. In this event, only those discharge cells in which the wall charges remain in the discharge space, i.e., those discharge cells which are in the "lit discharge cell state" discharge each time they are applied with the sustain pulses $IP_X$ and $IP_Y$ (sustain discharge). In other words, those discharge cells in which the selective erasure discharge was not generated in the addressing stage Wc repeat light emission associated with the sustain discharge the number of times allocated to each subfield as mentioned above to sustain the light emitting state.

Then, in the erasure stage E, the driver 100 applies the row electrodes $Y_1$–$Y_n$ with an erasure pulse EP as illustrated in FIG. 3. The application of the erasure pulse EP causes an erasure discharge to be generated in all the discharge cells of the PDP 10, thereby extinguishing the wall charges remaining in the respective discharge cells.

The foregoing sequence of operations comprised of the simultaneous reset stage Rc, addressing stage Wc, light emission sustain stage Ic and erasure stage E is executed in each of the subfields SF1–SF4 shown in FIG. 2. According to the driving as described, light is emitted associated with the sustain discharge number of times corresponding to a luminance level of an input video signal through one field display period to provide visually perceived intermediate luminance in accordance with the number of times of light emission. According to the gradation driving based on the four subfields SF1–SF4 as shown in FIG. 2, it is possible to represent 16 levels of intermediate luminance "0"-"15" (16 gradational levels).

Here, as one field period is divided into an increased number of subfields, a larger number of gradational levels can be represented to provide a display image of higher quality. For this purpose, the scanning pulse SP and pixel data pulse groups DP illustrated in FIG. 3 are reduced in pulse width to consume a less time for the addressing stage Wc, taking advantage of the resulting extra time to increase the number of subfields.

However, since the scanning pulse SP and pixel data pulse group DP having narrower pulse widths cause the selective discharge, as described above, to be instable, the pulse width cannot be thoughtlessly reduced.

OBJECT AND SUMMARY OF THE INVENTION

It is an object of the present invention to provide a method of driving a plasma display panel which is capable of displaying a high quality image with an increased number of gradation levels without rendering a selective discharge instable.

A plasma display panel driving method according to the present invention is adapted to drive a plasma display panel in cycles each comprising a plurality of subfields constituting one field of a video signal, the plasma display panel including a plurality of row electrodes corresponding to display lines, a plurality of column electrodes arranged to intersect the row electrodes, and discharge cells each formed at each of intersections of the row electrodes and the column electrodes for carrying a pixel. Each of the subfields includes an addressing stage for sequentially applying each of the column electrodes with one display line of pixel data pulses based on the video signal, and sequentially applying each of the row electrodes with a scanning pulse at the same timing as a timing at which each of the pixel data pulses is applied to selectively discharge each of the discharge cells to set the discharge cell to either a lit discharge cell state or an unlit discharge cell state, and a light emission sustain stage for repeatedly applying each of the row electrodes with a sustain pulse a number of times corresponding to weighting applied to the subfield to cause the discharge cells in the lit discharge cell state to repeatedly discharge such that the discharge cells emit light, wherein the scanning pulse and pixel data pulse applied at an earlier time in the addressing stage in each of the subfields have a narrower pulse width than a pulse width of the scanning pulse and the pixel data pulse which are applied at a later time in the addressing stage.

BRIEF DESCRIPTION OF THE DRAWINGS

FIG. 16 is a diagram showing an example of a conversion table for a second converter circuit 34, and a light emission pattern;

FIG. 20 is a diagram showing another example of a conversion table for the second converter circuit 34, and a light emission pattern; and FIG. 21 is a diagram showing a further example of a conversion table for the second converter circuit 34, and a light emission pattern.

DETAILED DESCRIPTION OF THE EMBODIMENTS

In the following, embodiments of the present invention will be described with reference to the drawings.

Figure 1:
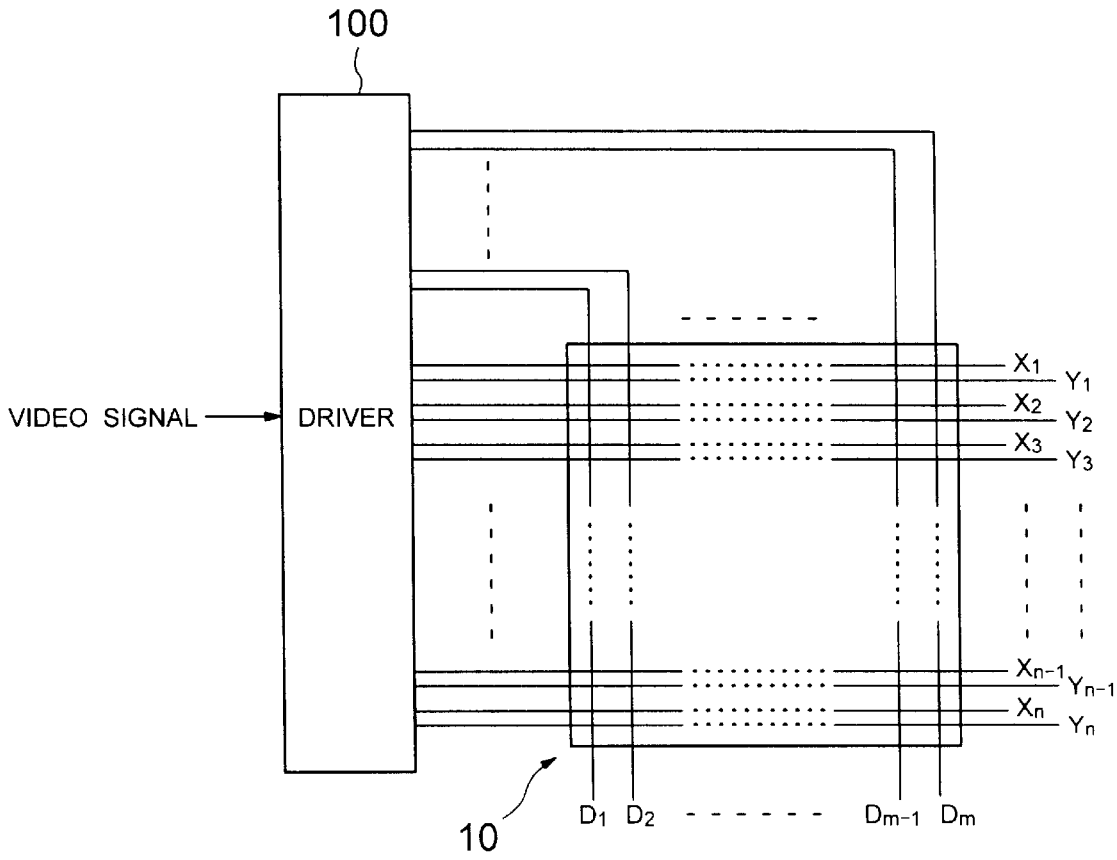
FIG. 1 is a diagram generally illustrating the configuration of a plasma display device.
Figure 2:
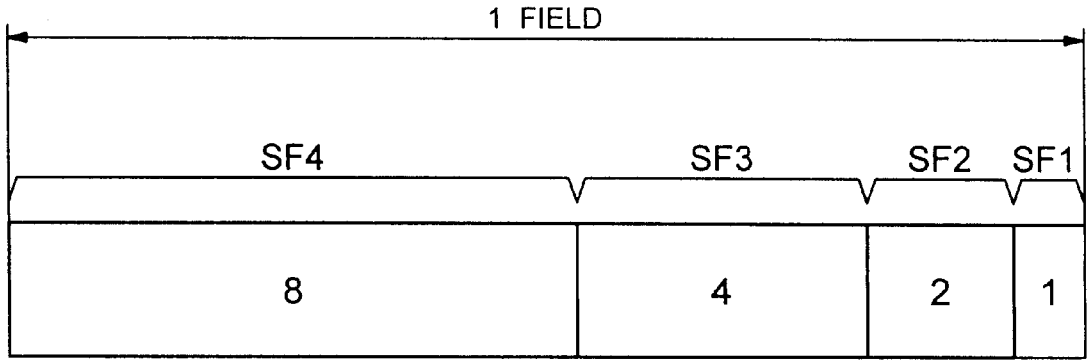
FIG. 2 is a diagram showing an exemplary light emission driving format based on a subfield method.
Figure 3:
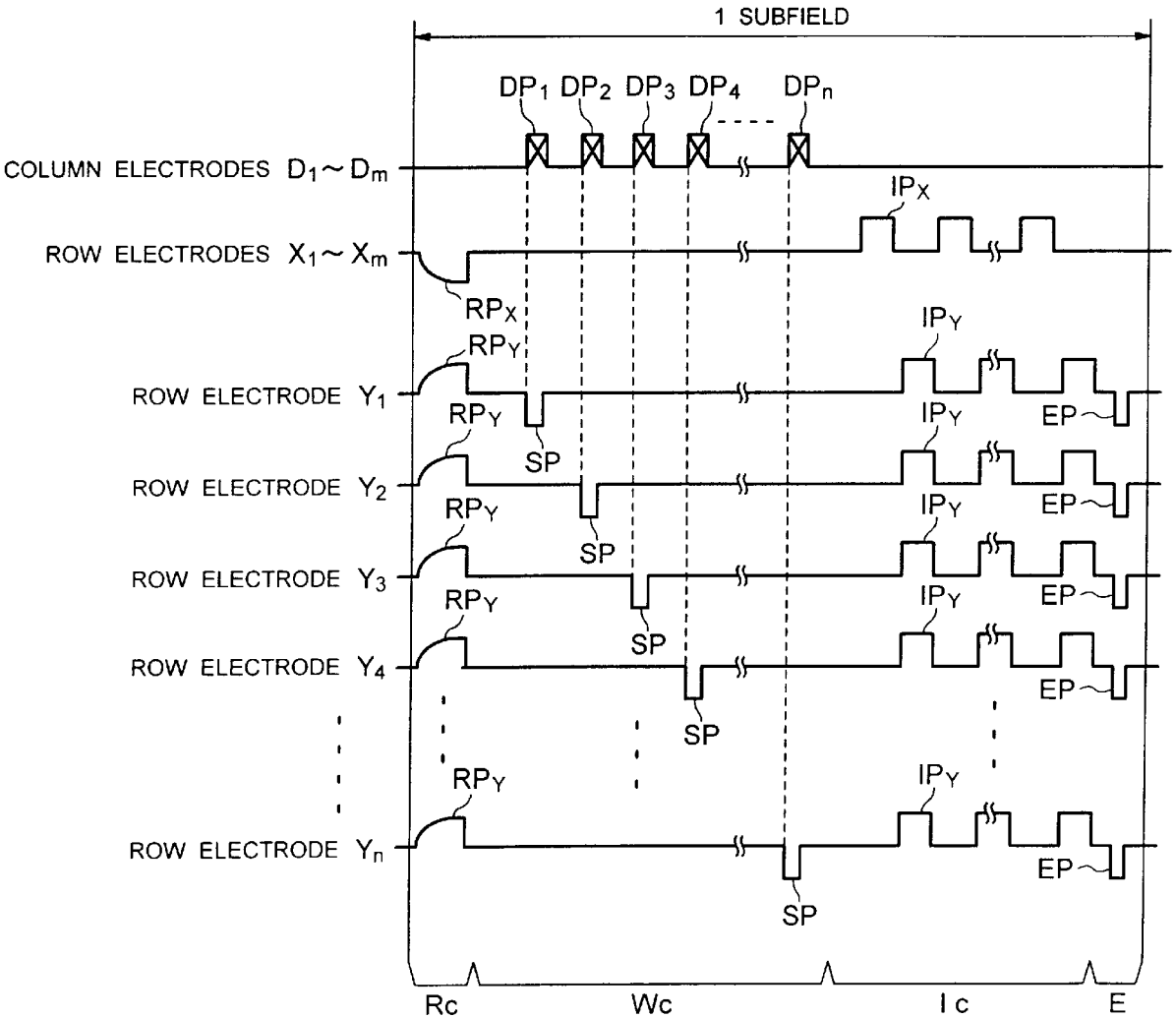
FIG. 3 is a diagram illustrating a variety of driving pulses applied by the driver 100 shown in FIG. 1 to column electrodes and row electrodes of a PDP 10 in one subfield, and timings at which the driving pulses are applied.
Figure 4:
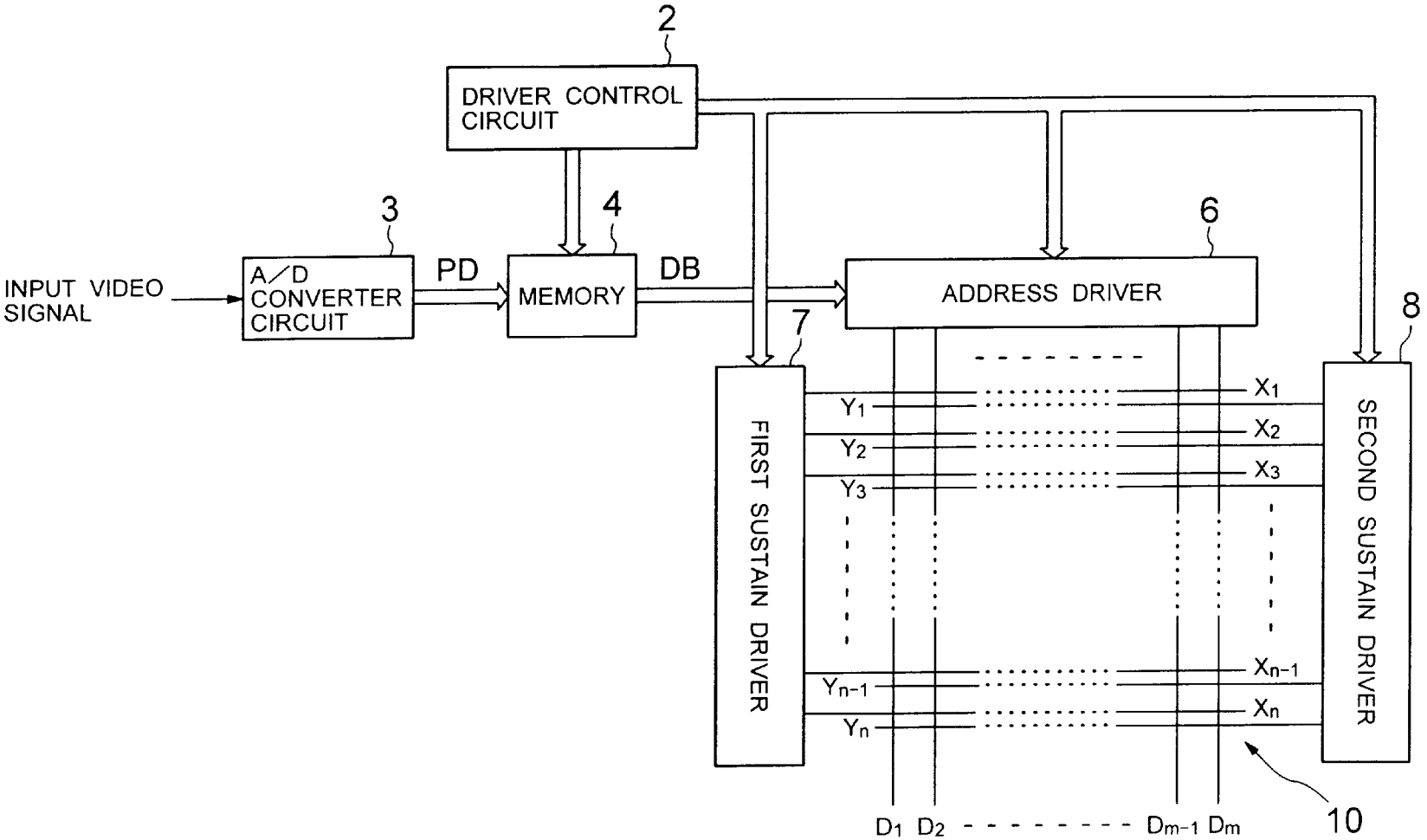
FIG. 4 is a diagram generally illustrating the configuration of a plasma display device for driving a plasma display panel in accordance with a driving method according to the present invention.

FIG. 4 is a diagram generally illustrating the configuration of a plasma display device which comprises a driving unit for driving a plasma display panel based on a driving method according to the present invention.

The plasma display device comprises a PDP 10 as a plasma display panel; and a driving unit comprised of a drive control circuit 2, an A/D converter 3, a memory 4, an address driver 6, a first sustain driver 7, and a second sustain driver 8.

The PDP 10 comprises m column electrodes $D_1$–$D_m$ as address electrodes, and n row electrodes $X_1$–$X_n$ and row electrodes $Y_1$–$Y_n$ which are arranged to intersect each of the column electrodes D. A pair of row electrodes $X_i$ ($1 \leqq i \leqq n$) and $Y_i$ ($1 \leqq i \leqq n$) in these row electrodes $X_1$–$X_n$ and $Y_1$–$Y_n$ carry a first display line—an n-th display line on the PDP 10. A discharge space filled with a discharge gas if formed between the column electrodes D and the row electrodes X, Y, and a discharge cell carrying a pixel is formed at an intersection of each row electrode pair and each column electrode, including the discharge space.

The A/D converter 3 converts an input video signal to 4-bit pixel data PD corresponding to each pixel, and supplies the pixel data PD to the memory 4.

The memory 4 sequentially writes the pixel data PD supplied from the A/D converter 3 in response to a write signal supplied from the drive control circuit 2. Then, the memory 4 performs a read operation as described below each time it has written one screen of pixel data, i.e., (n×m) pixel data PD from pixel data $PD_{11}$ corresponding to a pixel at the first row, first column to pixel data $PD_{nm}$ corresponding to a pixel at an n-th row, m-th column.

First, in a subfield SF4, later describe, the memory 4 regards the fourth bit, which is the most significant bit of each pixel data $PD_{11}$–$PD_{nm}$, as drive pixel data bit $DB4_{11}$-$DB4_{nm}$, and reads these drive pixel data bits on a display line basis, and supplies the drive pixel data bits to the address driver 6. Next, in a subfield SF3, later described, the memory 4 regards the third bit of each pixel data $PD_{11}$–$PD_{nm}$ as a drive pixel data bit $DB3_{11}$-$DB3_{nm}$, and reads these drive pixel data bits on a display line basis, and supplies the drive pixel data bits to the address driver 6. Next, in a subfield SF2, later described, the memory 4 regards the second bit of each pixel data $PD_{11}$–$PD_{nm}$ as a drive pixel data bit $DB2_{11}$-$DB2_{nm}$, and reads these drive pixel data bits on a display line basis, and supplies the drive pixel data bits to the address driver 6. Then, in a subfield SF1, later described, the memory 4 regards the first bit, which is the least significant bit of each pixel data $PD_{11}$–$PD_{nm}$, as a drive pixel data bit $DB1_{11}$-$DB1_{nm}$, and reads these drive pixel data bits on a display line basis, and supplies the drive pixel data bits to the address driver 6.

Figure 5:
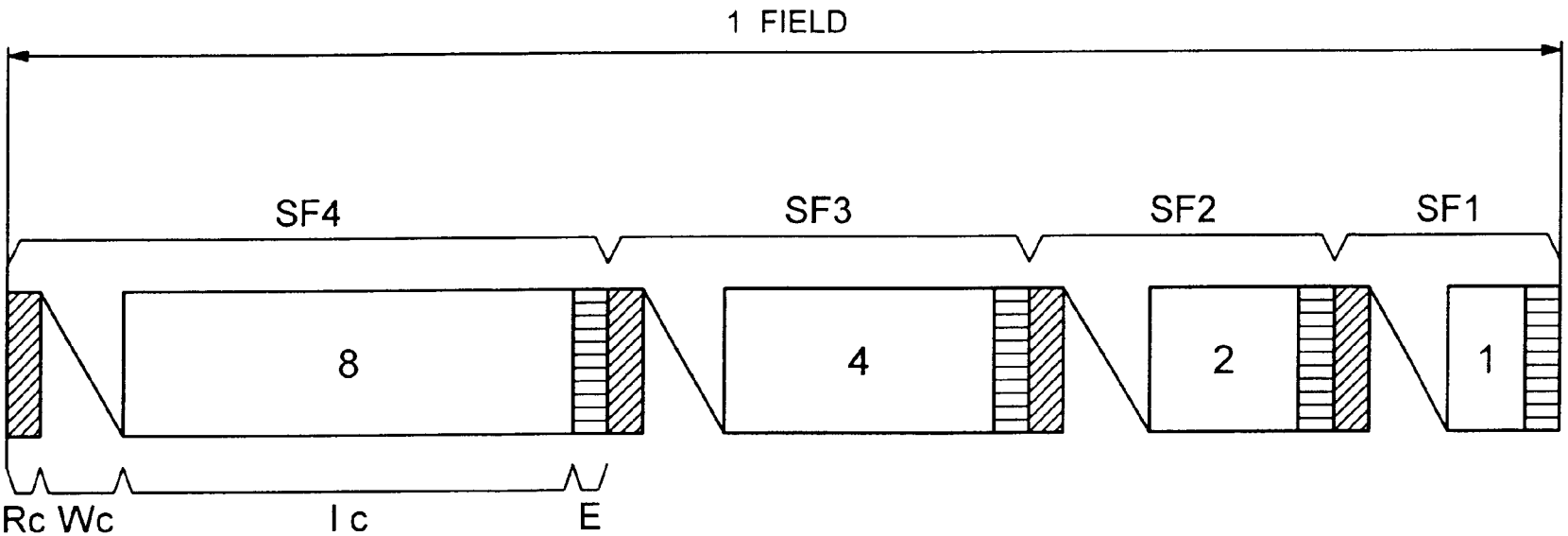
FIG. 5 is a diagram illustrating an exemplary light emission driving format for use in a drive control circuit 2 in the plasma display device illustrated in FIG. 4.

The drive control circuit 2 supplies each of the address driver 6, first sustain driver 7 and second sustain driver 8 with a variety of timing signals required to drive the PDP 10 for gradation representation in accordance with the light emission driving format illustrated in FIG. 5. In the light emission driving format illustrated in FIG. 5, one field display period is divided into four subfields SF1–SF4, and the simultaneous reset stage Rc, addressing stage Wc, light emission sustain stage Ic and erasure stage E are executed respectively in each subfield.

Figure 6:
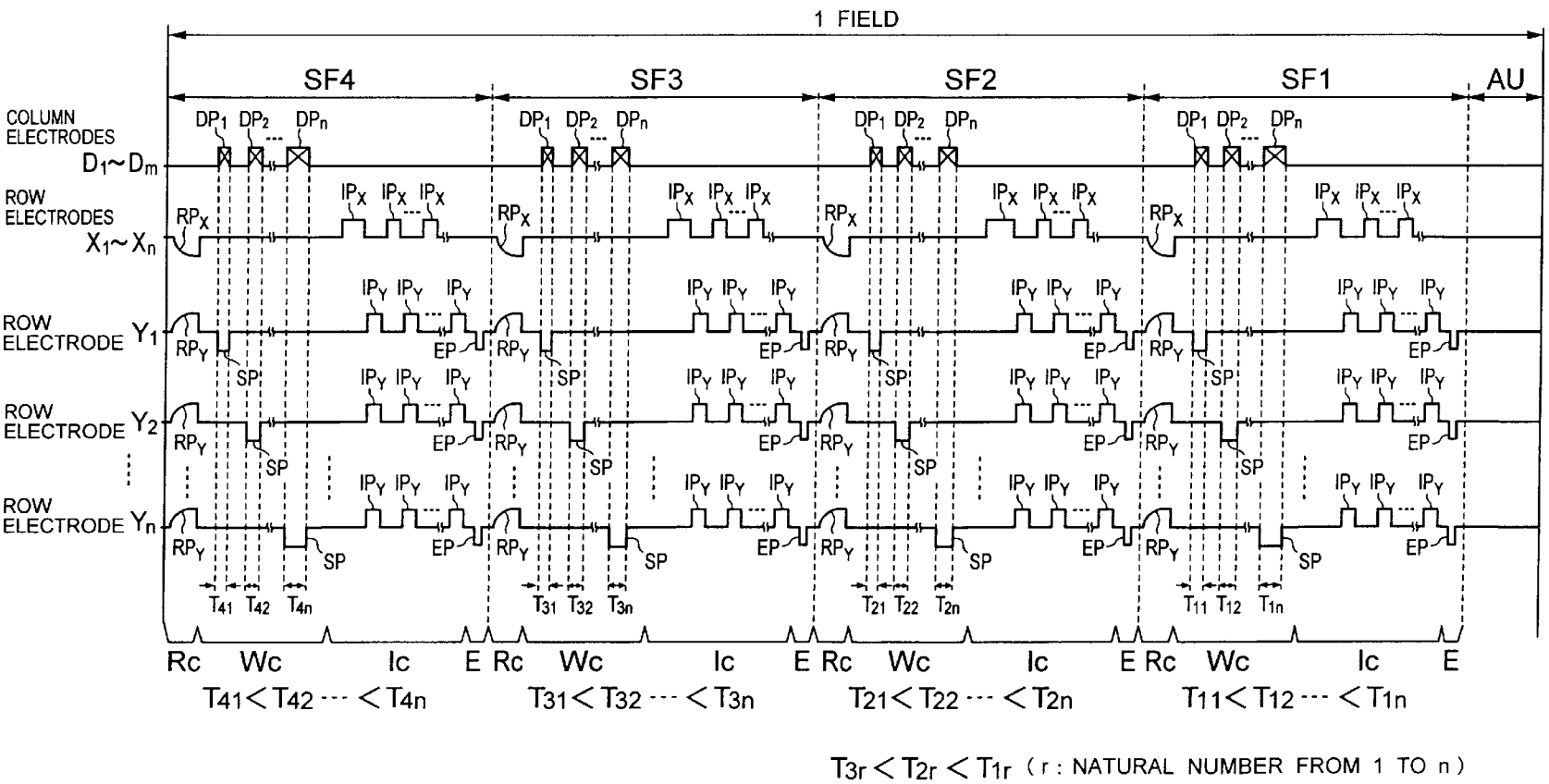
FIG. 6 is a diagram illustrating a variety of driving pulses applied to column electrodes and row electrodes of a PDP 10 in accordance with the light emission driving format illustrated in FIG. 5, and timings at which the driving pulses are applied.

FIG. 6 is a diagram illustrating a variety of driving pulses applied to the PDP 10 by each of the address driver 6, first sustain driver 7 and second sustain driver 8 in response to a variety of timing signals supplied from the drive control circuit 2, and timings at which the driving pulses are applied.

As can be seen in FIG. 6, in the simultaneous reset stage Rc executed at the beginning of each of the subfields SF1–SF4, the first sustain driver 7 generates a reset pulse $RP_X$ of negative polarity which is applied to the row electrodes $X_1$–$X_n$. Simultaneously with the reset pulse $RP_X$, the second sustain driver 8 generates a reset pulse $RP_Y$ of positive polarity which is applied to the row electrodes $Y_1$–$Y_n$. In response to the simultaneous application of these reset pulses $RP_X$, $RP_Y$, a reset discharge is generated in all discharge cells of the PDP 10 to form a wall charge in each of the discharge cell. In this manner, all the discharge cells are initialized to a "lit discharge cell state."

Next, in the addressing stage Wc, the address driver 6 generates pixel data pulses having pulse voltages in accordance with the pixel driving data bits DBs supplied from the memory 4, and applies one display line (m) of the generated pixel data pulses to the column electrodes $D_1$–$D_m$.

Specifically, in the subfield SF4, since the pixel driving data bits $DB4_{11}$-$DB4_{nm}$ is supplied from the memory 4, the address driver 6 generates a pixel data pulse having a pulse voltage in accordance with the logical level of each of the pixel driving data bits $DB4_{11}$-$DB4_{nm}$ in the addressing stage Wc of this SF4. Then, the address driver 6 first applies the column electrodes $D_1$–$D_m$ with a pixel data pulse group $DP_1$ comprised of m pixel data pulses corresponding to the first display line, and next applies the column electrodes $D_1$–$D_m$ with a pixel data pulse group $DP_2$ comprised of m pixel data pulses corresponding to the second display line. Similarly, the address driver 6 subsequently applies the column electrodes $D_1$–$D_m$ sequentially with pixel data pulse groups $DP_3$–$DP_n$ corresponding to the third to n-th display lines, respectively.

Also, in the subfield SF3, since the pixel driving data bits $DB3_{11}$-$DB3_{nm}$ is supplied from the memory 4, the address driver 6 generates a pixel data pulse having a pulse voltage in accordance with the logical level of each of the pixel driving data bits $DB3_{11}$-$DB3_{nm}$ in the addressing stage Wc of this SF3. Then, the address driver 6 first applies the column electrodes $D_1$–$D_m$ with a pixel data pulse group $DP_1$ comprised of m pixel data pulses corresponding to the first display line, and next applies the column electrodes $D_1$–$D_m$ with a pixel data pulse group $DP_2$ comprised of m pixel data pulses corresponding to the second display line. Similarly, the address driver 6 subsequently applies the column electrodes $D_1$–$D_m$ sequentially with pixel data pulse groups $DP_3$–$DP_n$ corresponding to the third to n-th display lines, respectively.

Further, in the subfield SF2, since the pixel driving data bits $DB2_{11}$-$DB2_{nm}$ is supplied from the memory 4, the address driver 6 generates a pixel data pulse having a pulse voltage in accordance with the logical level of each of the pixel driving data bits $DB2_{11}$-$DB2_{nm}$, in the addressing stage Wc of this SF2. Then, the address driver 6 first applies the column electrodes $D_1$–$D_m$ with a pixel data pulse group $DP_1$ comprised of m pixel data pulses corresponding to the first display line, and next applies the column electrodes $D_1$–$D_m$ with a pixel data pulse group $DP_2$ comprised of m pixel data pulses corresponding to the second display line. Similarly, the address driver 6 subsequently applies the column electrodes $D_1$–$D_m$ sequentially with pixel data pulse groups $DP_3$–$DP_n$ corresponding to the third to n-th display lines, respectively.

Further, in the subfield SF1, since the pixel driving data bits $DB1_{11}$-$DB1_{nm}$ is supplied from the memory 4, the address driver 6 generates a pixel data pulse having a pulse voltage in accordance with the logical level of each of the pixel driving data bits $DB1_{11}$-$DB1_{nm}$ in the addressing stage Wc of this SF1. Then, the address driver 6 first applies the column electrodes $D_1$–$D_m$ with a pixel data pulse group $DP_1$ comprised of m pixel data pulses corresponding to the first display line, and next applies the column electrodes $D_1$–$D_m$ with a pixel data pulse group $DP_2$ comprised of m pixel data pulses corresponding to the second display line. Similarly, the address driver 6 subsequently applies the column electrodes $D_1$–$D_m$ sequentially with pixel data pulse groups $DP_3$–$DP_n$ corresponding to the third to n-th display lines, respectively.

Moreover, in the addressing stage Wc of each of the subfields SF1–SF4, the second sustain driver 8 generates a scanning pulse SP having the same pulse width as each of the pixel data pulse groups $DP_1$–$DP_n$ at the same timing as each of these $DP_1$–$DP_n$, and sequentially applies the row electrodes $Y_1$–$Y_n$ with the scanning pulse SP, as illustrated in FIG. 6. Here, a discharge selectively occurs only in discharge cells at intersections of the display lines applied with the scanning pulse SP with the column electrodes applied with the pixel data pulse at the high voltage (selective erasure discharge). The selective erasure discharge extinguishes the wall charges previously formed in the discharge cells, causing the discharge cells to transition to the "unlit discharge cell state." On the other hand, the selective erasure discharge is not generated in discharge cells which have been applied with the pixel data pulse at the low voltage but together with the scanning pulse SP, so that these cells maintain the state in which they were initialized in the aforementioned simultaneous reset stage Rc, i.e., the "lit discharge cell state."

In other words, the addressing stage Wc is executed to set each of the discharge cells either to the "lit discharge cell state" or to the "unlit discharge cell state" in accordance with the pixel data corresponding to the input video signal.

Next, in the light emission sustain stage Ic in each subfield, the first sustain driver 7 and second sustain driver 8 respectively applies the row electrodes $X_1$–$X_n$ and $Y_1$–$Y_n$ alternately with sustain pulses $IP_X$, $IP_Y$ of positive polarity, as illustrated in FIG. 6. In this event, assuming that the number of times of application in the light emission sustain stage Ic in the subfield SF1 is "1," the number of times (or period) of the sustain pulses IP repeatedly applied in the light emission sustain stage Ic in each of the subfields SF1–SF4 is as follows:

SF1: 1

SF2: 2

SF3: 4

SF4: 8

In this event, only discharge cells in which the wall charges remain, i.e., the discharge cells which are in the "lit discharge cell state" in the addressing stage Wc discharge to sustain light emission each time they are applied with the sustain pulses $IP_X$, $IP_Y$, and sustain the light emitting state associated with the sustain discharge the number of times allocated thereto in each subfield.

Then, in the erasure stage E at the end of each subfield, the second sustain driver 8 applies the row electrodes $Y_1$–$Y_n$ with an erasure pulse EP as illustrated in FIG. 6. This causes all the discharge cells to simultaneously discharge to fully extinguish the wall charges remaining in the respective discharge cells.

As described above, according to the driving illustrated in FIGS. 5 and 6, only discharge cells which have been set to the "lit discharge cell state" in the addressing stage Wc in each subfield repeat light emission associated with the discharge the number of times mentioned above in the immediately following light emission sustain stage Ic. In this event, whether each discharge cell is set to the "lit discharge cell state" or to the "unlit discharge cell state" in the addressing stage Wc in each subfield depends on the pixel data PD. For example, when a first bit of the pixel data PD is at logical level "1," the discharge cell is set to the "unlit discharge cell state" in the addressing stage Wc of the subfield SF1. In this event, no sustain discharge is generated in the light emission sustain stage Ic of the subfield SF1, causing the discharge cell to remain in the unlit state. On the other hand, when the first bit of the pixel data PD is at logical level "0," the discharge cell is set to the "lit discharge cell state" in the addressing stage Wc of the subfield SF1. In this event, the sustain discharge is generated the number of times allocated to the subfield SF1 as mentioned above in the light emission sustain stage Ic in the subfield SF1, so that the discharge cell sustains the light emitting state in the meantime. Similarly, the discharge cells are set to either the "unlit discharge cell state" or the "lit discharge cell state" in the addressing stage Wc in each of the subfields SF2–SF4 in accordance with the logical level of each of the second to fourth bits of the pixel data PD. Then, only those discharge cells set to the "lit discharge cell state" discharge to sustain the light emission in the light emission sustain stage Ic in the subfield the number of times allocated thereto, so that they sustain the light emission in the meantime. According to the foregoing driving method, intermediate luminance is viewed in accordance with the total number of times of the sustain discharge light emission performed in each of the subfields SF1–SF4 within one field period.

Here, in the present invention, in the addressing stage Wc in each subfield, the scanning pulse SP and pixel data pulses, which are sequentially applied display line by display line, have the pulse widths narrower as they are applied earlier.

For example, in the addressing stage Wc in the subfield SF4, the scanning pulse SP applied to the row electrode $Y_1$ and the pixel data pulse group $PD_1$ applied to the column electrode D immediately after the simultaneous reset stage Rc have a pulse width $T_{41}$ narrower than a pulse width $T_{42}$ of the scanning pulse SP applied next to the row electrode $Y_2$ and the pixel data pulse group $DP_2$. Then, in the subfield SF4, the scanning pulse SP to the row electrode $Y_n$ and the pixel data pulse group $DP_n$ applied furthest away from the execution of the simultaneous reset stage Rc have the widest pulse width $T_{4n}$.

In other words, in the subfield SF4, the pulse widths $T_{41}$, $T_{42}$, $T_{43}$, . . . , $T_{4n}$ of the scanning pulse SP sequentially applied to the row electrodes $Y_1$, $Y_2$, $Y_3$, . . . , $Y_n$ and the pixel data pulse group DP are placed in the following relationship in terms of the magnitude:

$$T_{41}<T_{42}<T_{43}, \ldots, <T_{4n}$$

In the addressing stage Wc in the subfield SF3, the scanning pulse SP applied to the row electrode $Y_1$ and the pixel data pulse group $PD_1$ applied to the column electrode D immediately after the simultaneous reset stage Rc have a pulse width $T_{31}$ narrower than a pulse width $T_{32}$ of the scanning pulse SP applied next to the row electrode $Y_2$ and the pixel data pulse group $DP_2$. Then, in the subfield SF3, the scanning pulse SP to the row electrode $Y_n$ and the pixel data pulse group $DP_n$ applied furthest away from the execution of the simultaneous reset stage Rc have the widest pulse width $T_{3n}$.

In other words, in the subfield SF3, the pulse widths $T_{31}$, $T_{32}$, $T_{33}$, . . . , $T_{3n}$ of the scanning pulse SP sequentially applied to the row electrodes $Y_1$, $Y_2$, $Y_3$, . . . , $Y_n$ and the pixel data pulse group DP are placed in the following relationship in terms of the magnitude:

$T_{31}<T_{32}<T_{33}, \ldots <T_{3n}$

In the addressing stage Wc in the subfield SF2, the scanning pulse SP applied to the row electrode $Y_1$ and the pixel data pulse group $PD_1$ applied to the column electrode D immediately after the simultaneous reset stage Rc have a pulse width $T_{21}$ narrower than a pulse width $T_{22}$ of the scanning pulse SP applied next to the row electrode $Y_2$ and the pixel data pulse group $DP_2$. Then, in the subfield SF2, the scanning pulse SP to the row electrode $Y_n$ and the pixel data pulse group $DP_n$ applied furthest away from the execution of the simultaneous reset stage Rc have the widest pulse width $T_{2n}$.

In other words, in the subfield SF2, the pulse widths $T_{21}$, $T_{22}$, $T_{23}$, . . . , $T_{2n}$ of the scanning pulse SP sequentially applied to the row electrodes $Y_1$, $Y_2$, $Y_3$, . . . , $Y_n$ and the pixel data pulse group DP are placed in the following relationship in terms of the magnitude:

$T_{21}<T_{22}<T_{23}, \ldots , <T_{2n}$

In the addressing stage Wc in the subfield SF1, the scanning pulse SP applied to the row electrode $Y_1$ and the pixel data pulse group $PD_1$ applied to the column electrodes $D_1$–$D_m$ immediately after the simultaneous reset stage Rc have a pulse width $T_{11}$ narrower than a pulse width $T_{12}$ of the scanning pulse SP applied next to the row electrode $Y_2$ and the pixel data pulse group $DP_2$. Then, in the subfield SF1, the scanning pulse SP to the row electrode $Y_n$ and the pixel data pulse group $DP_n$ applied furthest away from the execution of the simultaneous reset stage Rc have the widest pulse width $T_{1n}$.

In other words, in the subfield SF1, the pulse widths $T_{11}$, $T_{12}$, $T_{13}$, . . . , $T_{1n}$ of the scanning pulse SP sequentially applied to the row electrodes $Y_1$, $Y_2$, $Y_3$, . . . , $Y_n$ and the pixel data pulse group DP are placed in the following relationship in terms of the magnitude:

$T_{11}<T_{12}<T_{13}, \ldots , <T_{1n}$

Specifically, since charged particles are formed in the discharge cells when the sustain discharge is repeatedly generated in the light emission sustain stage Ic in each subfield, the discharge cells are more likely to discharge. Stated another way, if the charged particles are sufficiently formed in the discharge cells, the discharge cells can generate selective discharges without fail in response to the driving pulses applied thereto even if the scanning pulse and pixel data pulse have a narrow pulse width. However, the charged particles gradually decrease over time.

Taking into account the foregoing characteristic, in the present invention, the scanning pulse and pixel data pulse applied in the addressing stage of each subfield have a narrower pulse width as they are applied at an earlier time. In this manner, the time consumed by the addressing stage is saved while the selective discharge is generated without fail.

Further, in the present invention, the scanning pulse and pixel data pulse applied in the addressing field in each subfield except for the first subfield of one field have a narrower pulse width as a larger number of sustain pulses are applied in the light emission sustain stage Ic in the preceding subfield. In this event, the light emission driving format illustrated in FIG. 5 shows that the largest number of sustain pulses are applied in the light emission sustain stage Ic in the subfield SF4, and the number of sustain pulses is reduced in the order of SF3, SF2, SF1.

This results in the establishment of a relationship in terms of the magnitude among a pulse width $T_{3r}$ of the scanning pulse SP applied to a row electrode $Y_r$ in the addressing stage Wc in the subfield SF3; a pulse width $T_{2r}$ of the scanning pulse SP applied to a row electrode $Y_r$ in the addressing stage Wc in the subfield SF2; and a pulse width $T_{1r}$ of the scanning pulse SP applied to a row electrode $Y_r$ in the addressing stage Wc in the subfield SF1:

$T_{3r}<T_{2r}<T_{1r}$ where r is a natural number from 1 to n.

For example, as illustrated in FIG. 6, a pulse width $T_{31}$ of the scanning pulse SP applied to the row electrode $Y_1$ and the pixel data pulse group $DP_1$ in the addressing stage Wc in the subfield SF3 is narrower than a pulse width $T_{21}$ of the scanning pulse SP applied to the row electrode $Y_1$ and the pixel data pulse group $DP_1$ in the addressing stage Wc in the subfield SF2. Also, the pulse width $T_{21}$ is narrower than a pulse width $T_{11}$ of the scanning pulse SP applied to the row electrode $Y_1$ and the pixel data pulse group $DP_1$ in the addressing stage Wc in the subfield SF1. Similarly, a pulse width $T_{32}$ of the scanning pulse SP applied to the row electrode $Y_2$ and the pixel data pulse group $DP_2$ in the addressing stage Wc in the subfield SF3 is narrower than a pulse width $T_{22}$ of the scanning pulse SP applied to the row electrode $Y_2$ and the pixel data pulse group $DP_2$ in the addressing stage Wc in the subfield SF2. Also, the pulse width $T_{22}$ is narrower than a pulse width $T_{12}$ of the scanning pulse SP applied to the row electrode $Y_2$ and the pixel data pulse group $DP_2$ in the addressing stage Wc in the subfield SF1.

Specifically, since a larger amount of charged particles is generated by the sustain discharges as the sustain discharges are generated a larger number of times in the light emission sustain stage Ic, each discharge cell is more likely to discharge. Therefore, in this event, the selective discharge is stably generated even if the scanning pulse SP and pixel data pulse are reduced in pulse width.

Thus, taking into account the foregoing characteristic, the scanning pulse and pixel data pulse applied in the addressing stage in each subfield except for the first subfield are reduced in pulse width as a larger number of sustain pulses are applied in the light emission sustain stage Ic in the preceding subfield. In this manner, the time consumed for the addressing stage is further saved while the selective discharge is generated without fail.

Figure 7:
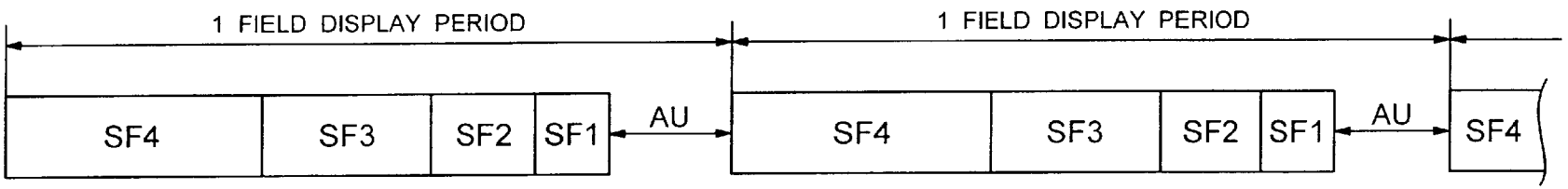
FIG. 7 is a diagram showing a timing for each of a subfield SF1, a preparatory period AU, and a subfield SF4.

The subfield preceding the first subfield SF4 is the last subfield SF1 in the preceding field to this field, as shown in FIG. 7. However, since a preparatory period AU is provided after the subfield SF1 for changing a driving sequence, a majority of charged particles formed in the light emission sustain stage Ic in the subfield SF1 will extinguish within the preparatory period AU. To solve this problem, as illustrated in FIG. 6, each of the pulse widths $T_{41}$, $T_{42}$, . . . , $T_{4m}$ of the scanning pulse SP and pixel data pulse applied in the addressing stage Wc in the first subfield SF4 is made wider as compared with each of the pulse widths $T_{31}$, $T_{32}$, . . . , $T_{3m}$, of the scanning pulse SP and pixel data pulse applied in the addressing stage Wc in the first subfield SF3.

As described above, the present invention takes into account the following characteristics:

1) charged particles formed by the sustain discharge decrease over time;
2) a larger amount of charged particles remains in a discharge cell as the sustain discharge is generated a larger number of times; and
3) With a large amount of charged particles remaining in a discharge cell, the selective discharge is stably generated even if the scanning pulse and pixel data pulse are reduced in pulse width, the scanning pulse and pixel data pulse applied in the addressing stage are reduced in pulse width as they are applied at an earlier time, and also as the sustain pulses are applied a larger number of times immediately before each addressing stage.

Thus, according to the present invention, the time consumed for each addressing stage can be saved by the reduction in the pulse width of the scanning pulse and pixel data pulse.

The method of driving a plasma display panel according to the present invention can be applied as well to a plasma display device which drives a plasma display panel in gradation representation in accordance with a light emission driving format other than the light emission driving format illustrated in FIG. 5.

Figure 8:
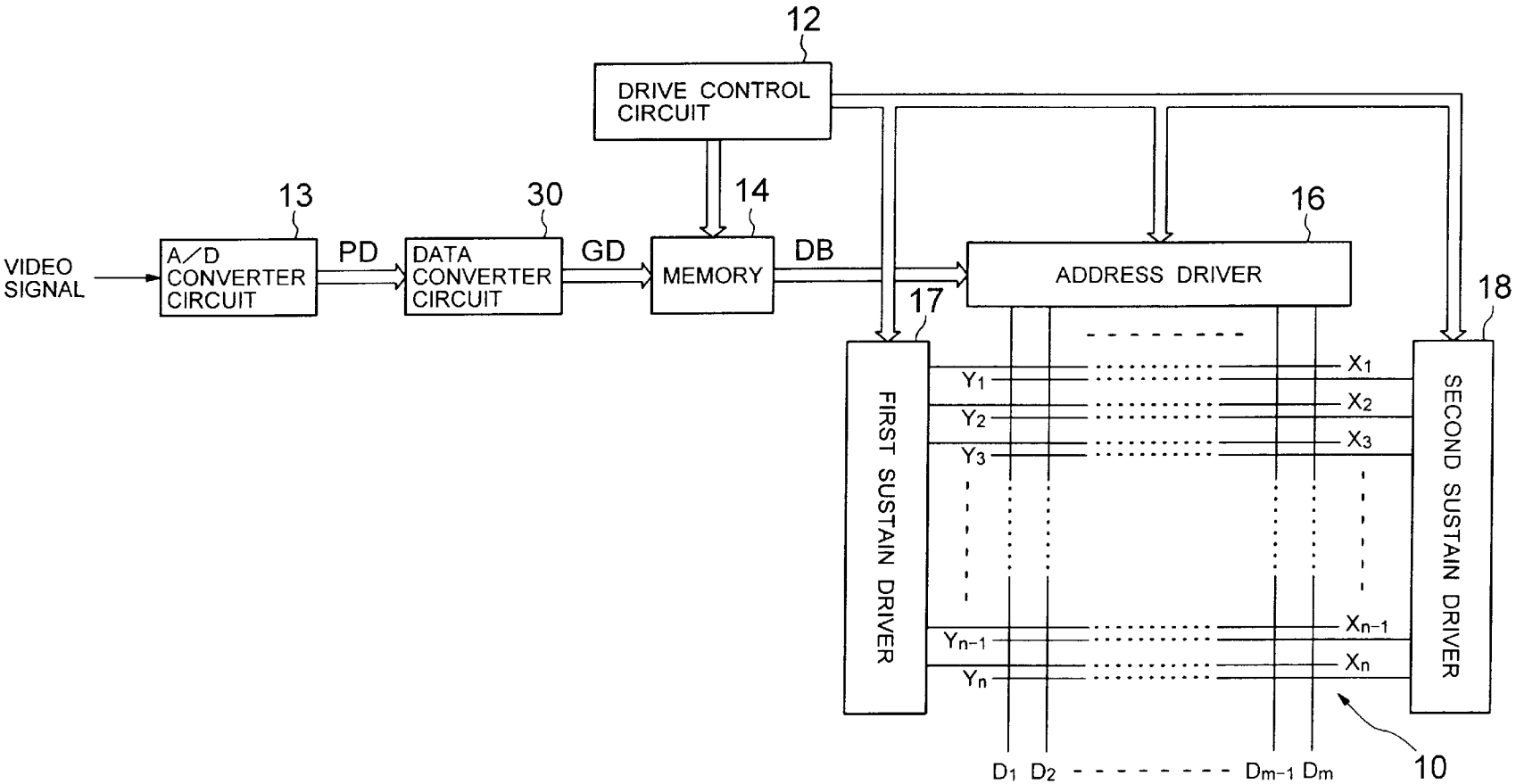
FIG. 8 is a diagram illustrating another configuration of a plasma display device for driving a plasma display panel in accordance with the driving method of the present invention.
Figure 9:
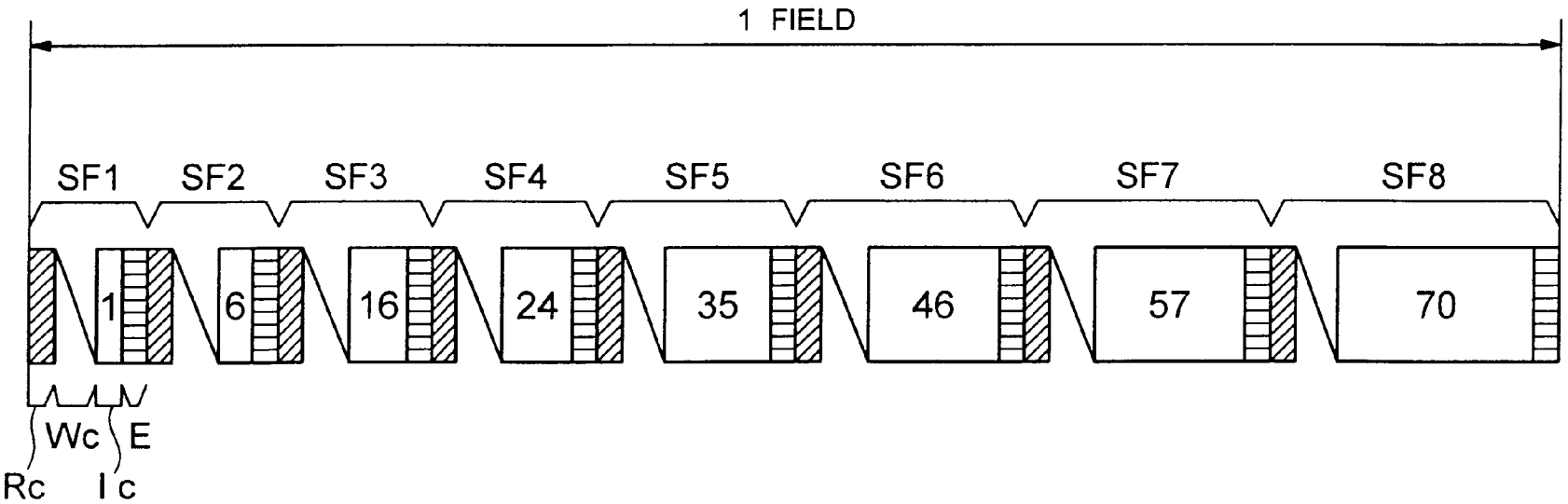
FIG. 9 is a diagram showing an exemplary light emission driving format for use in a drive control circuit 12 of the plasma display device illustrated in FIG. 8.

FIG. 8 is a diagram illustrating another configuration of a plasma display device for driving a plasma display panel in gradation representation in accordance with a light emission driving format shown in FIG. 9. In the light emission driving format shown in FIG. 9, one field display period is divided into eight subfields SF1–SF8, and the simultaneous reset stage Rc, addressing stage Wc, light emission sustain stage Ic and erasure stage E are executed respectively in each subfield.

The plasma display device illustrated in FIG. 8 comprises a PDP 10 as a plasma display panel; and a driving unit for driving the PDP 10 in accordance with an input video signal. The driving unit is comprised of a drive control circuit 12, an A/D converter 13, a memory 14, an address driver 16, a first sustain driver 17, a second sustain driver 18, and a data converter circuit 30.

The PDP 10 comprises m column electrodes $D_1$–$D_m$ as address electrodes, and n each of row electrodes $X_1$–$X_n$ and row electrodes $Y_1$–$Y_n$ which are arranged to intersect each of the column electrodes. A pair of row electrodes $X_i$ ($1 \leqq i \leqq n$) and $Y_i$ ($1 \leqq i \leqq n$) in these row electrodes $X_1$–$X_n$ and $Y_1$–$Y_n$ carry display lines on the PDP 10. These column electrodes D and row electrodes X, Y are disposed in opposition to each other with an intervening discharge space which is filled with a discharge gas, and a discharge cell carrying a pixel is formed at each of intersections of the row electrode pairs and column electrodes.

The A/D converter 3 converts an input video signal to 8-bit pixel data PD corresponding to each pixel, and supplies the pixel data PD to the data converter circuit 30.

Figure 10:
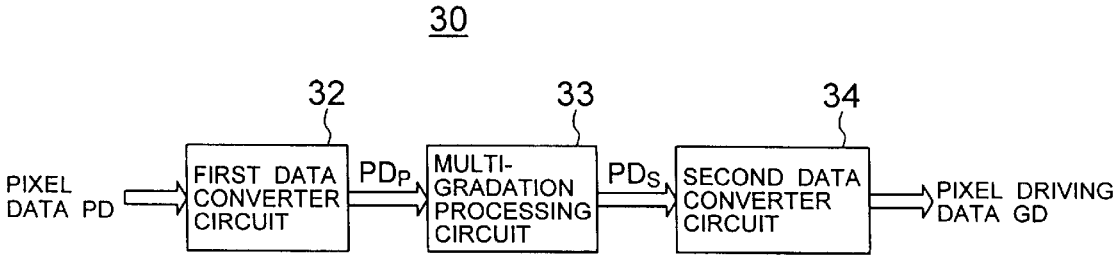
FIG. 10 is a diagram illustrating the internal configuration of a data converter circuit 30 in the plasma display device illustrated in FIG. 8.

FIG. 10 is a diagram illustrating the internal configuration of the data converter circuit 30.

Figure 11:
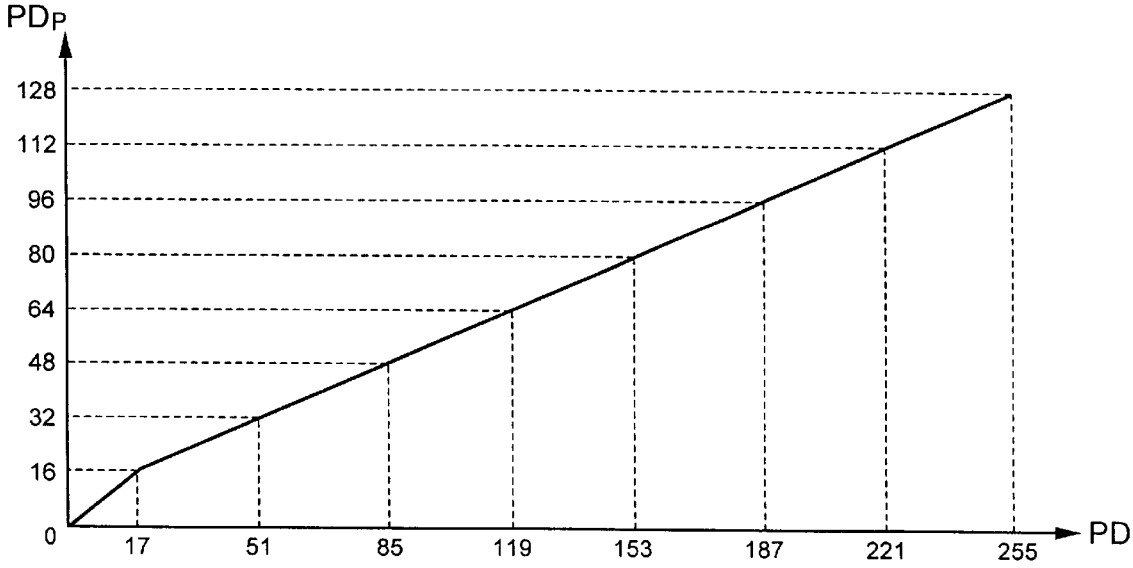
FIG. 11 is a graph showing a conversion characteristic in a first data converter circuit 32.

In FIG. 10, a first data converter circuit 32 converts the 8-bit pixel data PD capable of representing 256 gradation levels of luminance "0"-"255" to 8-bit luminance limiting pixel data $PD_P$ for limiting the luminance range to "0"-"128" in accordance with a conversion characteristic shown in FIG. 11. Then, the first data converter circuit 32 supplies the luminance limiting pixel data $PD_P$ to the multi-gradation processing circuit 33.

The multi-gradation processing circuit 33 applies multi-gradation processing such as error diffusion processing, dither processing and so on to the 8-bit luminance limiting pixel data $PD_P$. In this manner, the multi-gradation processing circuit 33 generates multi-gradation pixel data $PD_S$ which has its number of bits compressed to four bits while substantially maintaining the number of gradation representation levels of visually perceived luminance to 256 gradation levels.

Figure 12:
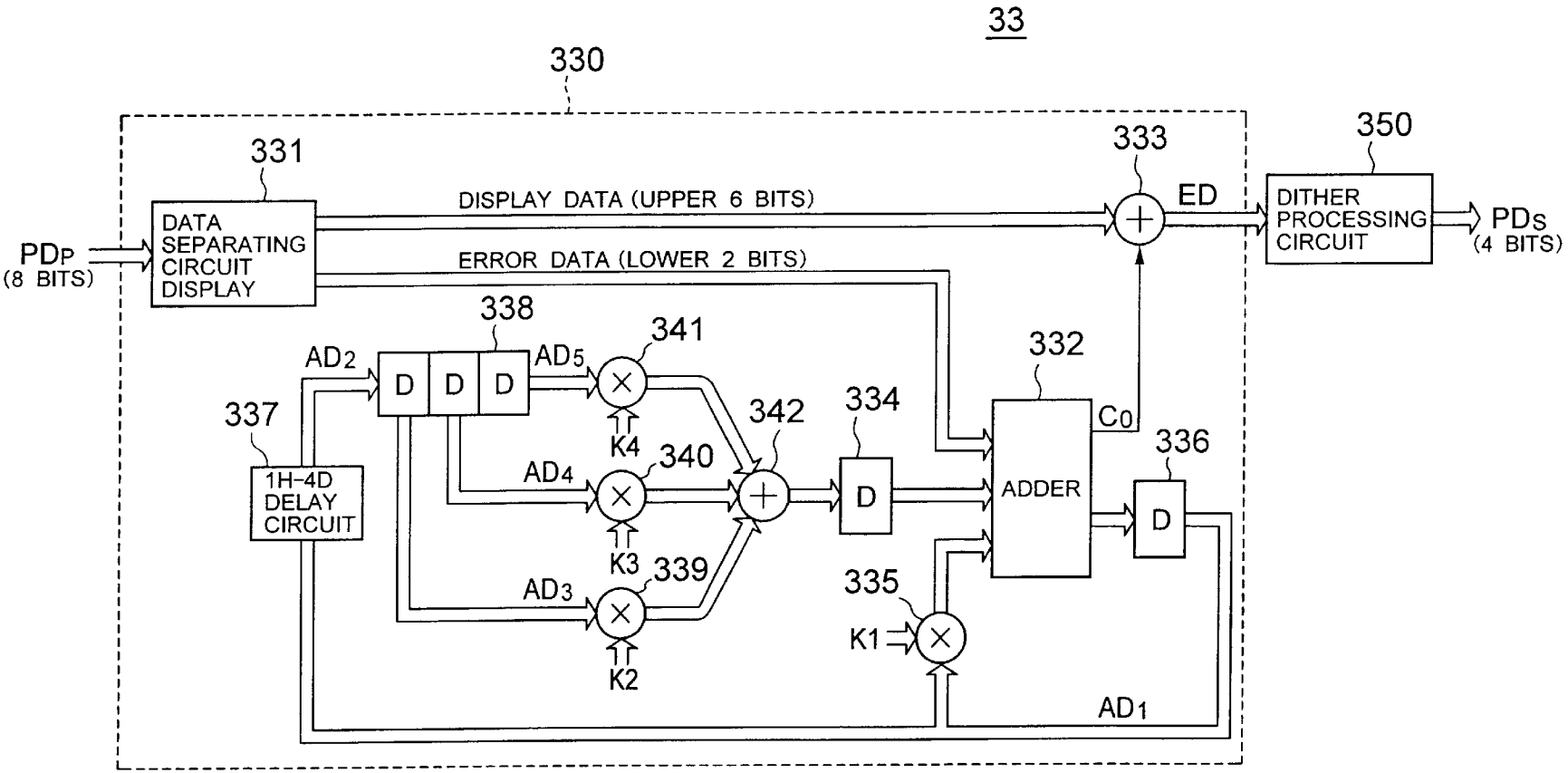
FIG. 12 is a diagram illustrating the internal configuration of a multi-gradation processing circuit 33.

FIG. 12 is a diagram illustrating the internal configuration of the multi-gradation processing circuit 33.

As illustrated in FIG. 12, the multi-gradation processing circuit 33 comprises an error diffusion processing circuit 330 and a dither processing circuit 350.

First, a data separating circuit 331 in the error diffusion processing circuit 330 separates the 8-bit luminance limiting pixel data $PD_P$ supplied from the first data converter circuit 32 into lower two bits as error data and upper six bits as display data. An adder 332 adds the error data, a delayed output from a delay circuit 334, and a multiplication output of a coefficient multiplier 335 to produce an addition value which is supplied to a delay circuit 336. The delay circuit 336 delays the addition value supplied from the adder 332 by a delay time D which has the same time as a sampling period of the pixel data PD, and supplies this to the coefficient multiplier 335 and delay circuit 337, respectively, as a delayed addition signal $AD_1$. The coefficient multiplier 335 multiplies the delayed addition signal $AD_1$ by a predetermined coefficient value $K_1$ (for example, "7/16") to produce a multiplication result which is supplied to the adder 332. The delay circuit 337 delays the delayed addition signal $AD_1$ further by a time expressed by (one horizontal scanning period minus delay time D multiplied by 4), and supplies the resulting signal to a delay circuit 338 as a delayed addition signal $AD_2$. The delay circuit 338 delays the delayed addition signal $AD_2$ further by the delay time D, and supplies the resulting signal to a coefficient multiplier 339 as a delayed addition signal $AD_3$. The delay circuit 338 also delays the delayed addition signal $AD_2$ further by a time expressed by the delay time D×2 to produce a delayed addition signal $AD_4$ which is supplied to a coefficient multiplier 340. The delay circuit 338 further delays the delayed addition signal $AD_2$ by a time expressed by the delay time D×3 to produce a delayed addition signal $AD_5$ which is supplied to a coefficient multiplier 341. The coefficient multiplier 339 multiplies the delayed addition signal $AD_3$ by a predetermined coefficient value $K_2$ (for example, "3/16"), and supplies the multiplication result to an adder 342. The coefficient multiplier 340 multiplies the delayed addition signal $AD_4$ by a predetermined coefficient value $K_3$ (for example, "5/16"), and supplies the multiplication result to an adder 342. The coefficient multiplier 341 multiplies the delayed addition signal $AD_5$ by a predetermined coefficient value $K_4$ (for example, "1/16"), and supplies the multiplication result to an adder 342. The adder 342 adds the multiplication results supplied respectively from the coefficient multipliers 339, 340, 341 to produce an addition signal which is supplied to the delay circuit 334. The delay circuit 334 delays the addition signal by a time equal to the delay time D, and supplies the delayed addition signal to the adder 332. The adder 332 generates a carry-out signal Co which is at logical level "0" when no carry is generated in the result of adding the error data supplied from the data separator circuit 331, the delay output from the delay circuit 334, and the multiplication output of the coefficient multiplier 335, and at logical level "1" when a carry is generated, and supplies the carry-out signal Co to the adder 333. The adder 333 adds the carry-out signal Co to the display data supplied from the data separating circuit 331, and outputs the resulting signal as 6-bit error diffusion processed pixel data ED.

Figure 13:
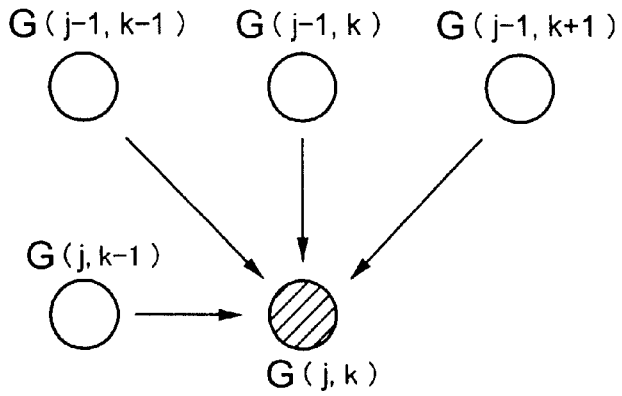
FIG. 13 is a diagram for explaining the operation of an error diffusion processing circuit 330.

In the following, the operation of the error diffusion processing circuit 330 will be described in connection with an example in which the error diffusion processed data ED is found corresponding to a pixel G(j,k) on the PDP 10, as illustrated in FIG. 13.

First, respective error data corresponding to a pixel G(j, k−1) on the left side of the pixel G(j, k), a pixel G(j−1, k−1) off to the upper left of the pixel G(j, k), a pixel G(j−1, k)

above the pixel G(j, k), and a pixel G(j−1, k+1) off to the upper right of the pixel G(j, k), i.e.:

error data corresponding to the pixel G(j, k−1): delayed addition signal $AD_1$;

error data corresponding to the pixel G(j−1, k+1); delayed addition data $AD_3$, error data corresponding to the pixel G(j−1, k): delayed addition data $AD_4$; and error data corresponding to the pixel G(j−1, k−1): delayed addition data $AD_5$, are added by the adder 332 as weighted with the predetermined coefficient values $K_1$–$K_4$, as mentioned above. The adder 332 also adds the two lower bits of the luminance limited pixel data $PD_P$, i.e., error data corresponding to the pixel G(j, k) to the addition result. Then, the adder 333 adds the carry-out signal $C_O$ resulting from the addition by the adder 332, and the upper six bits of the luminance limited pixel data $PD_P$, i.e., display data corresponding to the pixel G(j, k) to produce the error diffusion processed pixel data ED which is output from the error diffusion processing circuit 330.

Stated another way, the error diffusion processing circuit 330 regards the upper six bits of the luminance limited pixel data PDP as display data, and the remaining lower two bits as error data. Then, the error diffusion processing circuit 330 reflects the weighted addition of the error data at the respective peripheral pixels G(j, k−1), G(j−1, k+1), G(j−1, k), G(j−1, k−1) to the display data to produce the error diffusion processed pixel data ED. With this operation, the luminance for the two lower bits of the original pixel {G(j, k)} is virtually represented by the peripheral pixels, so that gradation representations of luminance equivalent to that provided by the 8-bit pixel data can be accomplished with display data having a number of bits less than eight bits, i.e., six bits. However, if the coefficient values for the error diffusion were constantly added to respective pixels, noise due to an error diffusion pattern could be visually recognized to cause a degraded image quality.

To eliminate this inconvenience, the coefficients $K_1$-$K_4$ for the error diffusion, which should be assigned to four pixels, may be changed from one field to another in a manner similar to dither coefficients, later described.

The dither processing circuit 350 illustrated in FIG. 12 performs dither processing on the error diffusion processed pixel data ED supplied from the error diffusion processing circuit 330. The dither processing is intended to represent intermediate luminance using a plurality of adjacent pixels. For example, four pixels vertically and horizontally adjacent to each other are grouped into one set, and four dither coefficients a–d having coefficient values different from one another are assigned to respective pixel data corresponding to the respective pixels in the set, and the resulting pixel data are added. In accordance with such dither processing, a combination of four different intermediate display levels can be produced with four pixels. However, if a dither pattern formed of the dither coefficients a–d were constantly added to each pixel, noise due to the dither pattern could be visually recognized, thereby causing a degraded image quality.

To eliminate this inconvenience, the dither processing circuit 350 changes the dither coefficients a–d assigned to four pixels from one field to another.

Figure 14:
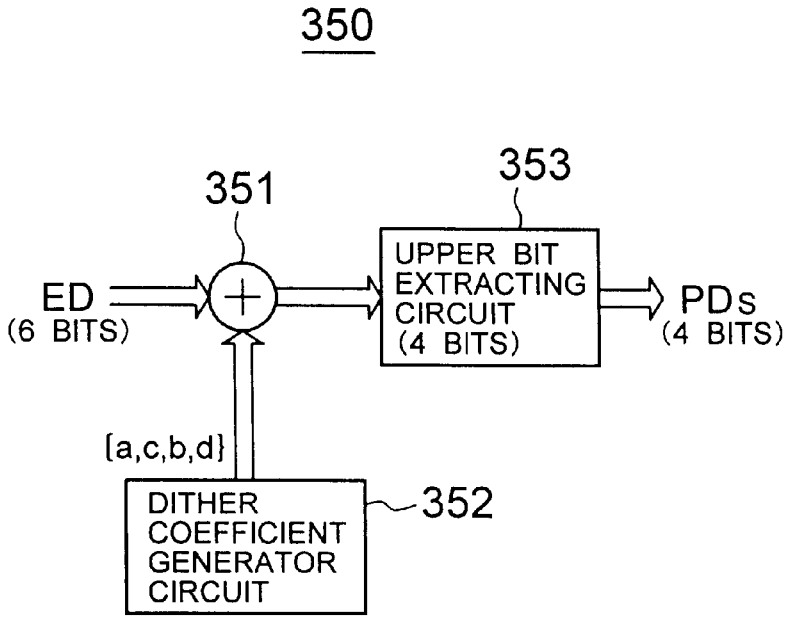
FIG. 14 is a diagram illustrating the internal configuration of a dither processing circuit 350.

FIG. 14 is a diagram illustrating the internal configuration of the dither processing circuit 350.

Figure 15:
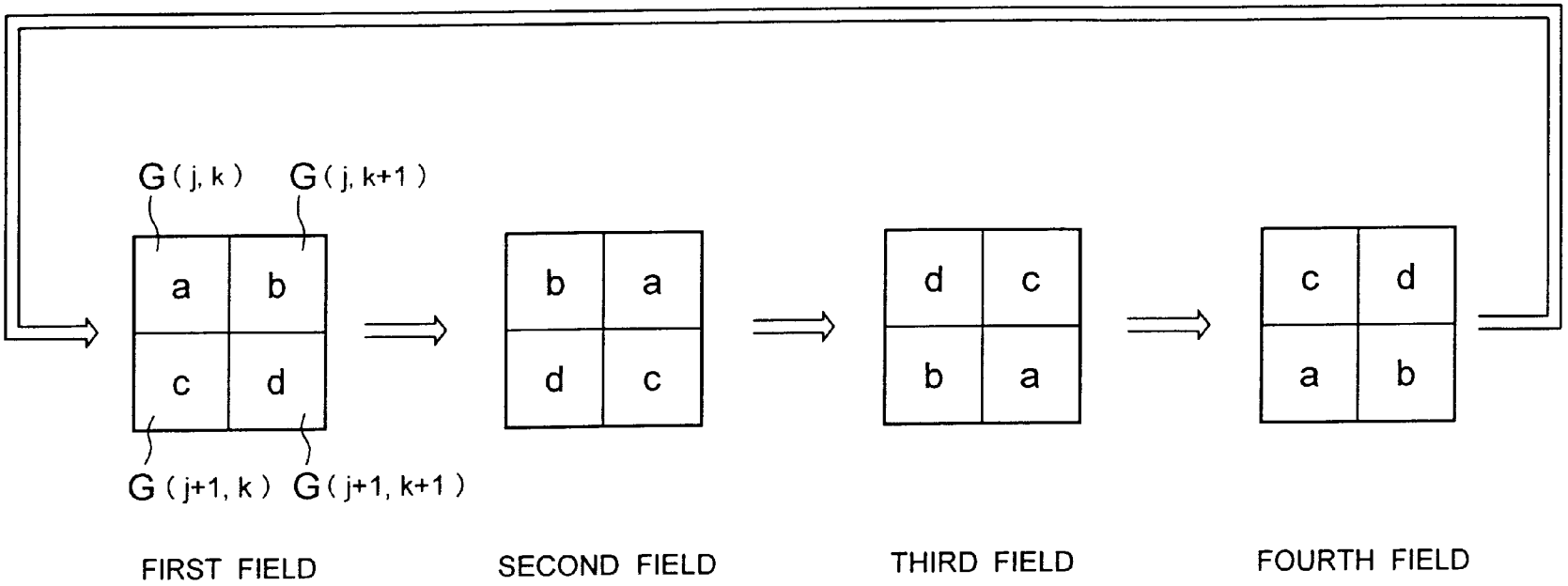
FIG. 15 is a diagram for explaining the operation of the dither processing circuit 350.

In FIG. 14, a dither coefficient generator circuit 352 generates four dither coefficients a, b, c, d which should be assigned respectively to four mutually adjacent pixels G(j, k), G(j,k+1), G(j+1,k), G(j+1,k+1), as shown in FIG. 15, and supplies these dither coefficients sequentially to an adder 351. In this event, the dither coefficient generator circuit 352 changes the dither coefficients a–d assigned to these four pixels from one field to another as shown in FIG. 15.

Specifically, the dither coefficient generator circuit 352 repeatedly generates the dither coefficients a–d in a cyclic manner with the following assignment:

in the first field:

| | |
|---|---|
| pixel G (j, k): | dither coefficient a |
| pixel G (j, k + 1): | dither coefficient b |
| pixel G (j + 1, k): | dither coefficient c |
| pixel G (j + 1, k + 1): | dither coefficient d |

in the second field:

| | |
|---|---|
| pixel G (j, k): | dither coefficient b |
| pixel G (j, k + 1): | dither coefficient a |
| pixel G (j + 1, k): | dither coefficient d |
| pixel G (j + 1, k + 1): | dither coefficient c |

in the third field:

| | |
|---|---|
| pixel G (j, k): | dither coefficient d |
| pixel G (j, k + 1): | dither coefficient c |
| pixel G (j + 1, k): | dither coefficient b |
| pixel G (j + 1, k + 1): | dither coefficient a |

in the fourth field:

| | |
|---|---|
| pixel G (j, k): | dither coefficient c |
| pixel G (j, k + 1): | dither coefficient d |
| pixel G (j + 1, k): | dither coefficient a |
| pixel G (j + 1, k + 1): | dither coefficient b |

Then, the dither coefficient generator circuit 352 repeatedly executes the operation in each of the first to fourth fields as described above. In other words, upon completion of the dither coefficient generating operation in the fourth field, the dither coefficient generator circuit 352 again returns to the operation in the first field to a repeat the foregoing operation.

The adder 351 shown in FIG. 14 adds the dither coefficients a–d to the error diffusion processed pixel data ED, respectively, supplied thereto from the error diffusion processing circuit 330, corresponding to the pixels G(j, k), G(j, k+1), G(j+1, k), G(j+1, k+1), to produce dither added pixel data which is supplied to an upper bit extracting circuit 353.

For example, in the first field shown in FIG. 15, the adder 351 sequentially supplies:

the error diffusion processed pixel data ED corresponding to the pixel G(j, k) plus the dither coefficient a;

the error diffusion processed pixel data ED corresponding to the pixel G(j, k+1) plus the dither coefficient b;

the error diffusion processed pixel data ED corresponding to the pixel G(j+1, k) plus the dither coefficient c; and the error diffusion processed pixel data ED corresponding to the pixel G(j+1, k+1) plus the dither coefficient d, to the upper bit extracting circuit 353 as the dither added pixel data.

The upper bit extracting circuit 353 extracts upper four bits of the dither added pixel data, and supplies the extracted bits to a second data converter unit 34 illustrated in FIG. 10 as multi-level gradation processed pixel data $PD_S$.

The second data converter unit 34 converts the 4-bit multi-level gradation processed pixel data $PD_S$ to 8-bit pixel driving data GD which is supplied to the memory 14 in accordance with a conversion table as shown in FIG. 16.

The memory 14 sequentially writes pixel driving data GD in response to a write signal supplied from the driving control circuit 12. Each time the pixel driving data for one screen, i.e., (n×m) pixel driving data $GD_{11}$–$GD_{nm}$ corresponding to respective pixels from the first row, first column to the n-th row, n-th column have been written into the memory 14, the memory 14 performs a reading operation as follows.

First, the memory 14 regards the first bits of the respective pixel driving data $GD_{11}$–$GD_{nm}$ as pixel driving data bits $DB1_{11}$-$DB1_{nm}$, and reads them for each display line and supplies them to the address driver 16 in the addressing stage Wc in the subfield SF1 shown in FIG. 9. Next, the memory 14 regards the second bits of the respective pixel driving data $GD_{11}$–$GD_{nm}$ as pixel driving data bits $DB2_{11}$-$DB2_{nm}$, and reads them for each display line and supplies them to the address driver 16 in the addressing stage Wc in the subfield SF2 shown in FIG. 9. Similarly, the memory 14 subsequently separates the third to eighth bits of the 8-bit pixel driving data GD, and reads pixel driving data bits DB3–DB8 at each bit digit for one display line respectively in the subfields SF3–SF8 shown in FIG. 9, and supplies them to the address driver 16.

The drive control circuit 12 generates a variety of timing signals for driving the PDP 10 to provide a gradation display in accordance with a light emission driving format as shown in FIG. 9, and supplies these timing signals to each of the address driver 16, first sustain driver 17 and second sustain driver 18.

Figure 17:
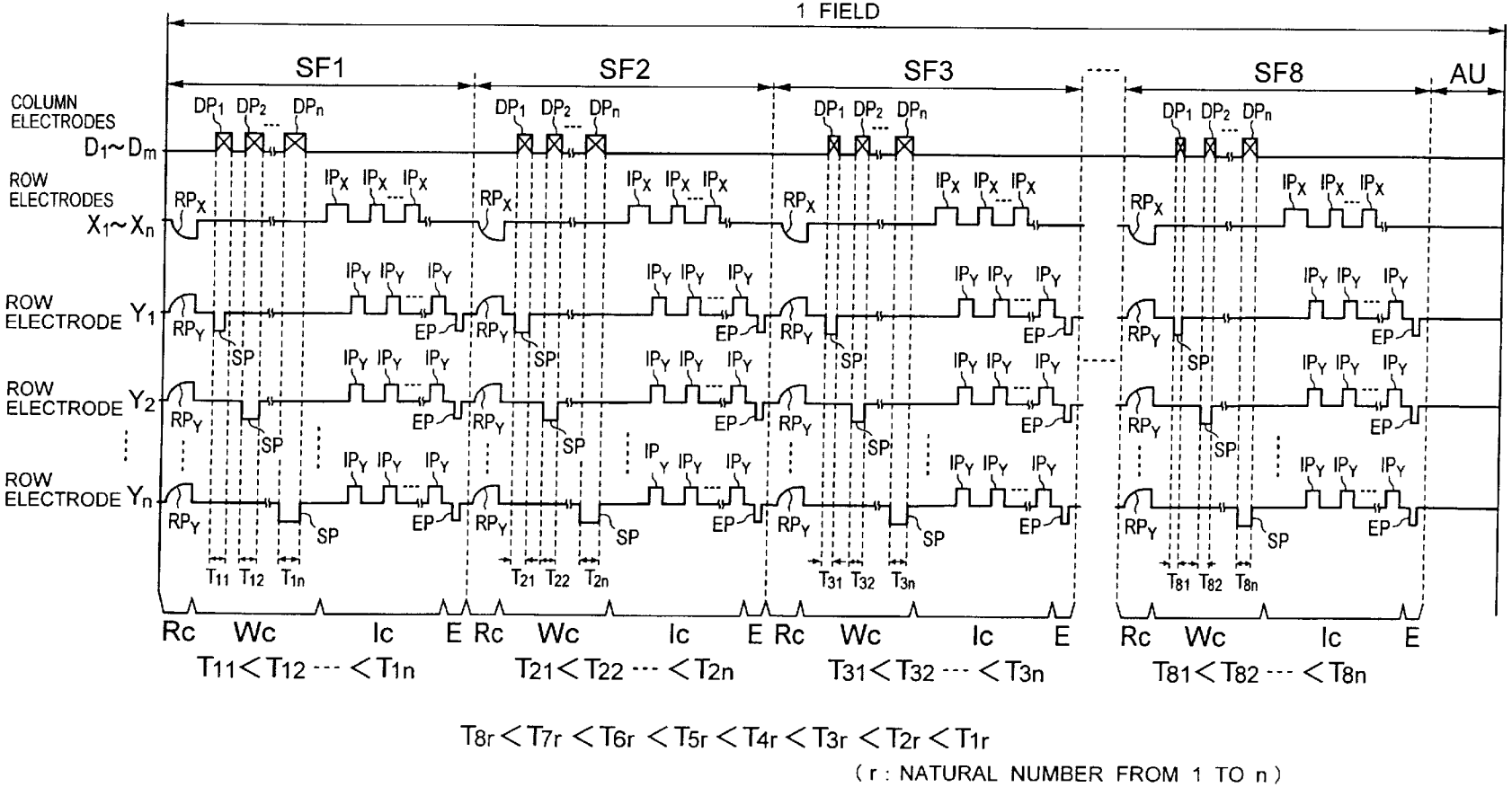
FIG. 17 is a diagram illustrating a variety of driving pulses applied to column electrodes and row electrodes of a PDP 10 in accordance with the light emission driving format shown in FIG. 9, and timings at which the driving pulses are applied.

FIG. 17 is a diagram illustrating a variety of driving pulses applied to the PDP 10 by the address driver 16, first sustain driver 17 and second sustain driver 18 in response to a variety of timing signals supplied from the driving control circuit 12, and timings at which the driving pulses are applied.

In FIG. 17, in the simultaneous reset stage Rc executed at the beginning of each of the subfields, the first sustain driver 17 generates a reset pulse $RP_X$ of negative polarity which is applied to the row electrodes $X_1$–$X_n$. Simultaneously with the reset pulse $RP_X$, the second sustain driver 18 generates a reset pulse $RP_Y$ of positive polarity which is applied to the row electrodes $Y_1$–$Y_n$. In response to the simultaneous application of these reset pulses $RP_X$, $RP_Y$, a reset discharge is generated in all discharge cells of the PDP 10 to form a wall charge in each of the discharge cells. In this manner, all the discharge cells are initialized to a "lit discharge cell state."

In the addressing stage Wc in each subfield, the address driver 16 generates a pixel data pulse having a pulse voltage in accordance with a pixel driving data bit DB supplied from the memory 14. For example, since the address driver 16 is supplied with a pixel driving data bit DB1 from the memory 14 in the subfield SF1, the address driver 16 generates a pixel data pulse having a pulse voltage corresponding to the logical level of the pixel driving data bit DB1. In this event, the address driver 16 generates the pixel data pulse at a high voltage when the pixel driving data pulse DB is at logical level "1" and a pixel data pulse at a low voltage (zero volt) when the drive pixel data pulse DB is at logical level "0."

Then, the address driver 16 groups the pixel data pulses into pixel data pulse groups $DP_1$, $DP_2$, . . . , $PD_n$ for each display line, and sequentially applies the pixel data pulse groups DP to the column electrodes $D_1$–$D_m$.

Further, in the addressing stage Wc, the second sustain driver 18 generates a scanning pulse SP of negative polarity at the same timing at which each of the pixel data pulse groups $DP_1$–$DP_n$ is applied, and sequentially applies the scanning pulse SP to the row electrodes $Y_1$–$Y_n$, as illustrated in FIG. 17. Here, a selective erasure discharge occurs only in discharge cells at intersections of the display lines applied with the scanning pulse SP with the column electrodes applied with the pixel data pulse at the high voltage. The selective erasure discharge extinguishes the wall charges which have remained in these discharge cells, causing the discharge cells to transition to the "unlit discharge cell state." On the other hand, the selective erasure discharge is not generated in discharge cells which have been applied with the scanning pulse SP but together with the pixel data pulse at the low voltage, so that these cells maintain the state in which they were initialized in the aforementioned simultaneous reset stage Rc, i.e., the "lit discharge cell state."

In other words, the addressing stage Wc is executed to set each of the discharge cells either to the "lit discharge cell state" or to the "unlit discharge cell state" in accordance with the pixel data corresponding to the input video signal.

Next, in the light emission sustain stage Ic in each subfield, the first sustain driver 17 and second sustain driver 18 respectively apply the row electrodes $X_1$–$X_n$ and $Y_1$–$Y_n$ alternately with sustain pulses $IP_X$, $IP_Y$ of positive polarity. In this event, assuming that the number of times of application in the light emission sustain stage Ic in the subfield SF1 is "1," the number of times (or period) of the sustain pulses IP repeatedly applied in the light emission sustain stage Ic in each of the subfields SF1–SF8 is as follows:

SF1: 1
SF2: 6
SF3: 16
SF4: 24
SF5: 35
SF6: 46
SF7: 57
SF8: 70

With the foregoing operation, only discharge cells in which the wall charges remain, i.e., the discharge cells which are in the "lit discharge cell state" in the addressing stage Wc discharge to sustain light emission each time they are applied with the sustain pulses $IP_X$, $IP_Y$, and sustain the light emitting state associated with the sustain discharge the number of times allocated thereto in each subfield.

Then, in the erasure stage E at the end of each subfield, the second sustain driver 18 applies the row electrodes $Y_1$–$Y_n$ with an erasure pulse EP as illustrated in FIG. 17. In this manner, the discharge cells are simultaneously discharged for erasure to fully extinguish the wall charges remaining in the respective discharge cells.

As described above, according to the driving based on the light emission driving format illustrated in FIG. 9, only discharge cells which have been set to the "lit discharge cell state" in the addressing stage Wc in each subfield maintain the light emitting state associated with the discharge the number of times mentioned above in the immediately following light emission sustain stage Ic. In this event, in the plasma display device illustrated in FIG. 8, the discharge cells are set to either the "lit discharge cell state" or the "unlit discharge cell state" in the addressing stage Wc in a subfield corresponding to a bit digit in accordance with the logic level of each bit of the pixel driving data GD as shown in FIG. 16. Specifically, when a bit in the pixel driving data GD is at logical level 1, the selective erasure discharge is generated in the addressing stage Wc in the subfield corresponding to the bit digit as indicated by a black circuit in FIG. 16. Therefore, the discharge cell is set to the "unlit discharge cell state" by the selective erasure discharge. On the other hand, when a bit in the pixel driving data GD is at logical level "0," the selective erasure discharge is not generated in the addressing stage Wc in the subfield corresponding to the bit digit. Therefore, the discharge cell maintains the "lit discharge cell state" so that the sustain discharge is repeatedly generated in the light emission sustain stage Ic in the subfield corresponding to the bit digit, as indicated by white circles in FIG. 16, to repeat the light emission associated with this discharge. Then, a variety of intermediate luminance is represented in step by the total sum of the number of times of light emission performed in the light emission sustain stage Ic in each of the subfields SF1–SF8.

Here, the 8-bit pixel driving data GD can take only nine patters as shown in FIG. 16. Therefore, according to the driving using the nine patterns of pixel driving data GD, an intermediate display luminance representation is provided at nine gradation levels which have visual light emission luminance viewed within one field period in the following ratio:

{0, . . . , 1, 7, 23, 47, 82, 128, 185, 255}.

The pixel data PD is capable of inherently representing halftones at 256 gradation levels with eight bits. Thus, for realizing a halftone luminance display close to 256 levels even with the aforementioned 9-gradation level driving, the multi-gradation processing circuit 33 performs the multi-gradation processing such as the error diffusion, dither processing, and the like.

In the driving using nine types of pixel driving data GD shown in FIG. 16, the sustain discharge light emission is performed in the discharge cells without fail in the first subfield SF1 except for the luminance equal to "0." Then, until the selective erasure discharge is generated in a subfield subsequent to the subfield SF2, the sustain discharge light emission is performed in successive subfields as indicated by white circles. In this event, once the selective erasure discharge is generated in one subfield, the selective erasure discharge is also generated in succession in each of subsequent subfields as indicated by black circles to maintain the discharge cells in the "unlit discharge cell state."

In other words, one field display period includes a continuous light emission state in which the sustain discharge light emission is generated in successive subfields as indicated by white circles, and a continuous unlit state in which selective erasure discharge is generated in successive subfields as indicated by black circles. In this event, in one field display period, the number of times a discharge cell transitions from the continuous light emission state to the continuous unlit state is one or less, and once the discharge cell transitions to the continuous unlit state, it will not return to the continuous light emission state in this field display period. In other words, as shown in FIG. 16, the nine types of light emission driving patterns according to the nine types of pixel driving data GD do not include a light emission pattern which causes a discharge cell to alternately transition to the continuous light emission state (white circle) and the continuous unlit state (black circle) in one field period. Therefore, according to this driving, the generation of spurious contour is prevented as would be otherwise generated when such inverted light emission patterns appear in two adjacent regions within a display screen.

In this event, as illustrated in FIG. 17, when the foregoing driving is performed, in the addressing stage Wc in each subfield, the scanning pulse SP and pixel data pulse applied to the PDP 10 have a narrower pulse width as they are applied at an earlier time.

Specifically, as illustrated in FIG. 17, in the subfield SF1, the pulse widths $T_{11}, T_{12}, T_{13}, \ldots, T_{1n}$ of the scanning pulse SP sequentially applied to the row electrodes $Y_1, Y_2, Y_3, \ldots, Y_n$ and the pixel data pulse group DP are placed in the following relationship in terms of the magnitude:

$T_{11}<T_{12}<T_{13}, \ldots <T_{1n}$

In the subfield SF2, the pulse widths $T_{21}, T_{22}, T_{23}, \ldots, T_{2n}$ Of the scanning pulse SP sequentially applied to the row electrodes $Y_1, Y_2, Y_3, \ldots, Y_n$ and the pixel data pulse group DP are placed in the following relationship in terms of the magnitude:

$T_{21}<T_{22}<T_{23}, \ldots, <T_{2n}$

In the subfield SF3, the pulse widths $T_{31}, T_{32}, T_{33}, \ldots, T_{3n}$ of the scanning pulse SP sequentially applied to the row electrodes $Y_1, Y_2, Y_3, \ldots, Y_n$ and the pixel data pulse group DP are placed in the following relationship in terms of the magnitude:

$T_{31}<T_{32}<T_{33}, \ldots, <T_{3n}$

In the subfield SF4, the pulse widths $T_{41}, T_{42}, T_{43}, \ldots, T_{4n}$ of the scanning pulse SP sequentially applied to the row electrodes $Y_1, Y_2, Y_3, \ldots, Y_n$ and the pixel data pulse group DP are placed in the following relationship in terms of the magnitude:

$T_{41}<T_{42}<T_{43}, \ldots, <T_{4n}$

In the subfield SF5, the pulse widths $T_{51}, T_{52}, T_{53}, \ldots, T_{5n}$ of the scanning pulse SP sequentially applied to the row electrodes $Y_1, Y_2, Y_3, \ldots, Y_n$ and the pixel data pulse group DP are placed in the following relationship in terms of the magnitude:

$T_{51}<T_{52}<T_{53}, \ldots, <T_{5n}$

In the subfield SF6, the pulse widths $T_{61}, T_{62}, T_{63}, \ldots, T_{6n}$ of the scanning pulse SP sequentially applied to the row electrodes $Y_1, Y_2, Y_3, \ldots, Y_n$ and the pixel data pulse group DP are placed in the following relationship in terms of the magnitude:

$T_{61}<T_{62}<T_{63}, \ldots <T_{6n}$

In the subfield SF7, the pulse widths $T_{71}, T_{72}, T_{73}, \ldots, T_{7n}$ of the scanning pulse SP sequentially applied to the row electrodes $Y_1, Y_2, Y_3, \ldots, Y_n$ and the pixel data pulse group DP are placed in the following relationship in terms of the magnitude:

$T_{71}<T_{72}<T_{73}, \ldots, <T_{7n}$

In the subfield SF8, the pulse widths $T_{81}, T_{82}, T_{83}, \ldots, T_{8n}$ of the scanning pulse SP sequentially applied to the row electrodes $Y_1, Y_2, Y_3, \ldots, Y_n$ and the pixel data pulse group DP are placed in the following relationship in terms of the magnitude:

$T_{81}<T_{82}<T_{83}, \ldots, <T_{8n}$

In addition, the scanning pulse and pixel data pulse applied in the addressing stage of each subfield have a narrower pulse width as a total number of applied sustain pulses is larger from the beginning of one field to immediately before the subfield. Here, according to the driving using the nine types of pixel driving data GD as shown in FIG. 16, except for representation of a luminance level "0," the sustain discharge is generated without fail in each of successive subfields from the first subfield SF1. Therefore, the largest total number of sustain pulses are applied in the last subfield SF8 until immediately before the addressing stage of the subfield in one field, while the smallest total number of sustain pulses are applied in the first subfield SF1. Therefore, as illustrated in FIG. 17, the pulse widths $T_{1r}$–$T_{8r}$ of the scanning pulse SP applied to a row electrode Yr and the pixel data pulse group DPr in the addressing stage Wc in each of the subfields SF1–SF8 are placed in the following relationship in terms of the magnitude:

$T_{8r}<T_{7r}<T_{6r}<T_{5r}<T_{4r}<T_{3r}<T_{2r}<T_{1r}$ where r is a natural number from 1 to n.

Specifically, more charged particles exist within a discharge cell as the sustain discharge is generated a larger number of times until immediately before the addressing stage. Since this discharge cell is more likely to discharge, a stable selective discharge can be generated even if the scanning pulse and pixel data pulse are reduced in pulse width. Therefore, as described above, the time consumed for the addressing stage is further saved by narrowing the pulse width of the scanning pulse and pixel data pulse applied in later subfields than the pulse width of the scanning pulse and pixel data pulse applied in the addressing stage in the first subfield of one subfield.

Figure 18:
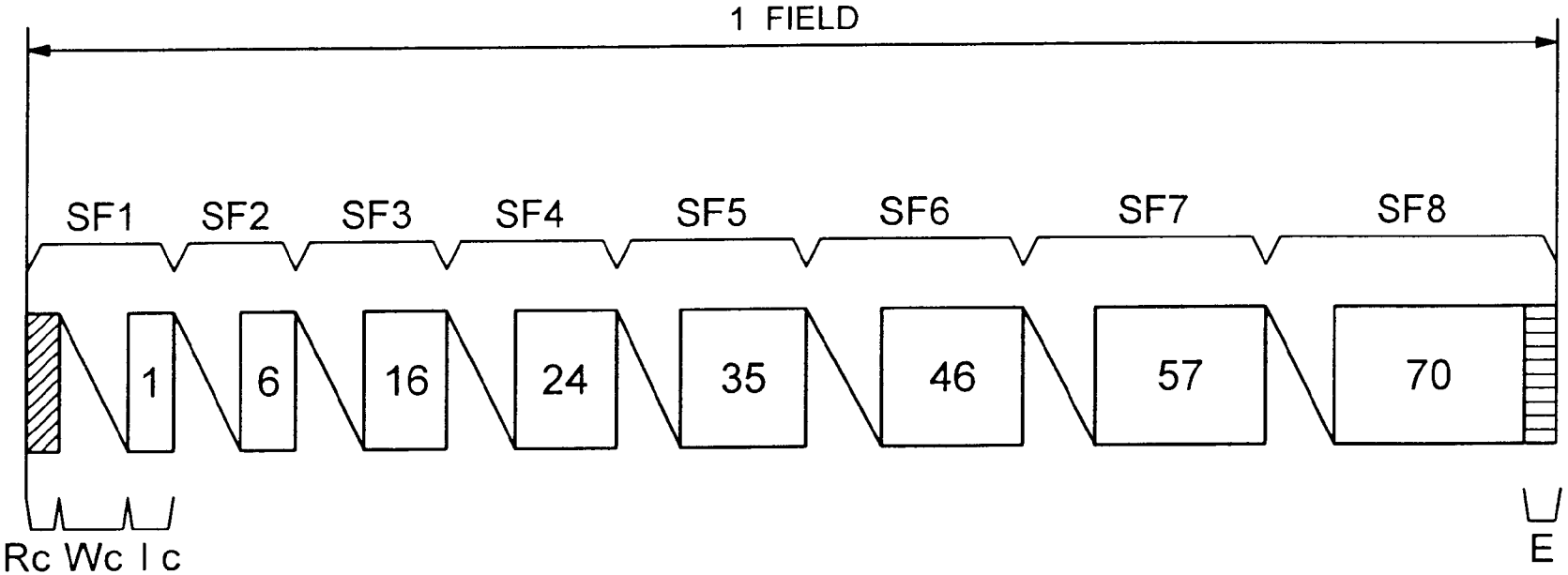
FIG. 18 is a diagram showing another exemplary light emission driving format for use in a drive control circuit 12 in the plasma display device illustrated in FIG. 8.

Alternatively, the plasma display device illustrated in FIG. 8 may employ a light emission driving format shown in FIG. 18, instead of the light emission driving format shown in FIG. 9 to perform the gradation driving for the PDP 10.

The light emission driving format shown in FIG. 18 is similar to the light emission driving format shown in FIG. 9 in that the addressing stage Wc and light emission sustain stage Ic are executed respectively in each of the subfields SF1–SF8. However, in the light emission driving format shown in FIG. 18, the simultaneous reset stage Rc as described above is executed only in the first subfield SF1, and the erasure stage E is executed only in the last subfield SF8.

Figure 19:
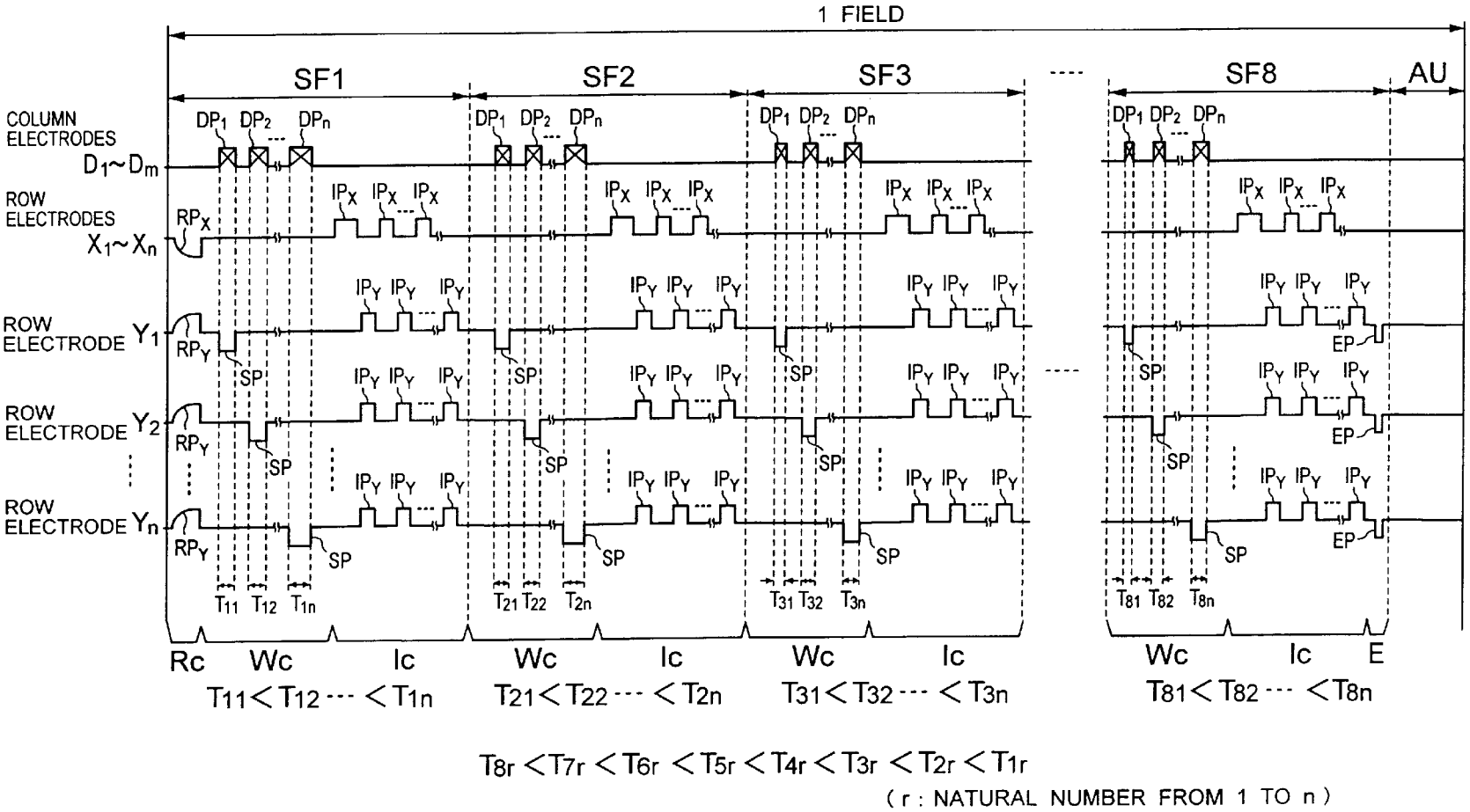
FIG. 19 is a diagram illustrating a variety of driving pulses applied to the column electrodes and row electrodes of the PDP 10 in accordance with the light emission driving format illustrated in FIG. 18, and timings at which the driving pulses are applied.

FIG. 19 is a diagram illustrating a variety of driving pulses applied to the PDP 10 by the address driver 16, first sustain driver 17 and second sustain driver 18 in FIG. 8 for performing the driving in accordance with the light emission driving format shown in FIG. 18, and timings at which the driving pulses are applied.

As can be seen in FIG. 19, in the simultaneous reset stage Rc executed only in the first subfield SF1, the first sustain driver 17 generates a reset pulse RPx of negative polarity which is applied to the row electrodes $X_1$–$X_n$. Simultaneously with the reset pulse $RP_X$, the second sustain driver 18 generates a reset pulse $RP_Y$ of positive polarity which is applied to the row electrodes $Y_1$–$Y_n$. In response to the simultaneous application of these reset pulses $RP_X$, $RP_Y$, a reset discharge is generated in all discharge cells of the PDP 10 to form a wall charge in each of the discharge cells. In this manner, all the discharge cells are initialized to a "lit discharge cell state."

Next, in the addressing stage Wc in each of the subfields SF1–SF8, the address driver 16 sequentially applies pixel data pulse groups $DP_1$, $DP_2$, $DP_3$, . . . , $PD_n$ as mentioned above to the column electrodes $D_1$–$D_m$ as illustrated in FIG. 19. In this event, the second sustain driver 18 generates a scanning pulse SP of negative polarity at the same timing at which each of the pixel data pulse groups $DP_1$–$DP_n$ is applied, and sequentially applies the scanning pulse SP to the row electrodes $Y_1$–$Y_n$. Here, a selective erasure discharge occurs only in discharge cells at intersections of the display lines applied with the scanning pulse SP with the column electrodes applied with the pixel data pulse at a high voltage. The selective erasure discharge extinguishes the wall charges which have remained in these discharge cells, causing the discharge cells to transition to the "unlit discharge cell state." On the other hand, the selective erasure discharge is not generated in discharge cells which have been applied with the scanning pulse SP but together with the pixel data pulse at the low voltage. Therefore, these discharge cells maintain the state until immediately before as it is. Stated another way, a discharge cell which has been in the "lit discharge cell state" immediately before the scanning pulse SP is applied thereto is set to the "lit discharge cell state" as it is, while a discharge cell which has been in the "unlit discharge cell state" is set to the "unlit discharge cell state" as it is.

Next, in the light emission sustain stage Ic in each of the subfields SF1–SF8, the first sustain driver 17 and second sustain driver 18 respectively apply the row electrodes $X_1$–$X_n$ and $Y_1$–$Y_n$ alternately with sustain pulses $IP_X$, $IP_Y$ of positive polarity, as illustrated in FIG. 19. In this event, assuming that the number of times of application in the light emission sustain stage Ic in the subfield SF1 is "1," the number of times (or period) of the sustain pulses IP repeatedly applied in the light emission sustain stage Ic in each of the subfields SF1–SF8 is as follows:

SF1: 1
SF2: 6
SF3: 16
SF4: 24
SF5: 35
SF6: 46
SF7: 57
SF8: 70

With the foregoing operation, only discharge cells in which the wall charges remain, i.e., the discharge cells which are in the "lit discharge cell state" in the addressing stage Wc discharge to sustain light emission each time they are applied with the sustain pulses $IP_X$, $IP_Y$, and sustain the light emitting state associated with the sustain discharge the number of times allocated thereto in each subfield.

Then, in the erasure stage E executed only in the last subfield SF8, the second sustain driver 18 applies the row electrodes $Y_1$–$Y_n$ with an erasure pulse EP as illustrated in FIG. 19. In this manner, the discharge cells are simultaneously discharged for erasure to fully extinguish the wall charges remaining in the respective discharge cells.

FIG. 20 is a diagram showing a data conversion table for use in the second data converter circuit 34 in the data converter circuit 30 for performing the driving in accordance with the light emission driving format illustrated in FIG. 18, and a light mission driving pattern in one field period.

According to the pixel driving data GD generated in accordance with the data conversion table, the selective erasure discharge is generated only in the addressing stage Wc in one of the subfields SF1–SF8, as indicated by a black circle in FIG. 20. In this event, it is only the simultaneous reset stage Rc in the first subfield SF1 that can form a wall charge in a discharge cell and make this discharge cell transition from the "unlit discharge cell state" to the "lit discharge cell state." Therefore, the discharge cell maintains the "lit discharge cell state" until the selective erasure discharge is generated in one of the subfields SF1–SF8 (indicated by a black circle). Then, the discharge cell repeatedly executes light emission associated with the sustain discharge in the light emission sustain stage 1c in each of intervening subfields (indicated by white circles). Therefore, according to the driving shown in FIGS. 18–20, the light emission pattern in one field display period is identical to that which is provided when the light emission driving format as illustrated in FIG. 9 is employed, so that an intermediate display luminance representation is provided at nine gradation levels which have the following light emission luminance ratio:

{0, 1, 7, 23, 47, 82, 128, 185, 255}.

However, in the driving shown in FIGS. 18–20, the reset discharge is performed only once in one field display period. In other words, the contrast of the screen can be improved, as compared with the driving performed as shown in FIGS. 9 and 16, by a reduction in the number of times of reset discharges associated with light emission not related to display contents.

In this event, the scanning pulse and pixel data pulse are reduced in pulse width as they are applied at an earlier time in each subfield, as illustrated in FIG. 19, in a manner similar to the aforementioned embodiment (the driving illustrated in FIG. 17). Further, like the driving illustrated in FIG. 17, the scanning pulse and pixel data pulse applied in the addressing stage in the subfield are reduced in pulse width as a larger number of sustain pulses are applied until immediately before each addressing stage (from the beginning of one field).

According to the pixel driving data GD shown in FIG. 20, the selective erasure discharge is generated only in one of the subfields SF1–SF8. However, the selective erasure discharge may not be normally generated if a small amount of charged particles remain in a discharge cell.

To avoid this failed selective erasure discharge, a conversion table shown in FIG. 21 may be used in the second data converter circuit 34 instead of that shown in FIG. 20.

"*" shown in FIG. 21 means that the logical level may be either "1" or "0," while a triangle indicates that the selective erasure discharge is generated only when "*" is at logical level "1."

According to the pixel driving data GD shown in FIG. 21, the selective erasure discharge is performed in the addressing stage Wc in each of at least two successive subfields. That is to say, even if the first selective erasure discharge is incomplete, charged particles are generated even from such an incomplete selective erasure discharge, so that the second selective erasure discharge is normally performed.

In the foregoing embodiment, the pulse width of the scanning pulse and pixel data pulse is gradually changed from one display line to another as illustrated in FIGS. 6, 17 and 19. Alternatively, the pulse width may be changed at intervals of a plurality of number of display lines. For example, in the addressing stage Wc in the subfield SF1, the pulse width of the scanning pulse SP applied to the row electrodes $Y_1$–$Y_3$ is chosen to be the same pulse width $T_{11}$, while the pulse width of the scanning pulse SP applied to the row electrodes $Y_4$–$Y_6$ is chosen to be a pulse width $T_{12}$ wider than the pulse width $T_{11}$. From then on, the pulse width of the scanning pulse SP is increased for every three display lines.

Also, in the embodiment illustrated in FIGS. 6, 17 and 19, the pulse width of the scanning pulse and pixel data pulse is changed every subfield. Alternatively, the pulse width may be changed every plural number of display lines. For example, the pulse widths $T_{1r}$–$T_{8r}$ of the scanning pulse SP applied to the row electrode $Y_r$ and the pixel data pulse in the addressing stage Wc in each of the subfields SF1–SF8 are changed every two subfields in the following manner:

$$T_{8r}=T_{7r}<T_{6r}=T_{5r}<T_{4r}=T_{3r}<T_{2n}=T_{1r}$$

where r is a natural number from 1 to n.

As described above in detail, in the present invention, the scanning pulse and pixel data pulse applied in the addressing stage in each subfield have a narrower pulse width as they are applied at an earlier time.

Therefore, according to the present invention, since the time consumed for he addressing stage can be saved while ensuring a stable selective erasure discharge, it is possible to display a high quality image with a large number of gradation levels if the number of subfields is increased by the reduction in time.

This application is based on Japanese Patent Application No. 2001–189601 which is herein incorporated by reference.

What is claimed is:

1. A plasma display panel driving method for driving a plasma display panel in cycles each comprises a plurality of subfields constituting one field of a video signal, said plasma display panel including a plurality of row electrodes corresponding to display lines, a plurality of column electrodes arranged to intersect said row electrodes, and discharge cells each formed at each of intersections of said row electrodes and said column electrodes for carrying a pixel, wherein:

each of said subfields includes:

an addressing stage for sequentially applying each of said column electrodes with one display line of pixel data pulses based on said video signal, and sequentially applying each of said row electrodes with a scanning pulse at the same timing as a timing at which each of said pixel data pulses is applied to selectively discharge each of said discharge cells to set said discharge cell to either a lit discharge cell state or an unlit discharge cell state; and a light emission sustain stage for repeatedly applying each of said row electrodes with a sustain pulse a number of times corresponding to weighting applied to said subfield to cause said discharge cells in said lit discharge cell state to repeatedly discharge such that said discharge cells emit light, and said scanning pulse and said pixel data pulse applied at an earlier time in said addressing stage in each of said subfields have a narrower pulse width than a pulse width of said scanning pulse and said pixel data pulse which are applied at a later time in said addressing stage.

2. A plasma display panel driving method according to claim 1, wherein the pulse width of said scanning pulse and said pixel data pulse is changed in accordance with the number of said sustain pulses applied immediately before said addressing stage.

3. A plasma display panel driving method according to claim 2, wherein the pulse width of said scanning pulse and said pixel data pulse applied in said addressing stage is narrowed as a larger number of sustain pulses are applied in said light emission sustain stage in one of said subfields immediately before said addressing stage.

4. A plasma display panel driving method according to claim 1, wherein the pulse width of said scanning pulse and said pixel data pulse is narrowed as a larger number of sustain pulses are applied in said light emission sustain stage in each of said subfields from the beginning of one field to immediately before said addressing stage.

5. A plasma display panel driving method according to claim 1, wherein:

only the first subfield in one field display period has a reset stage prior to said addressing stage for initializing all said discharge cells to either said lit discharge cell state or said unlit discharge cell state, and said selective discharge is generated only in said addressing stage in one of said subfields in each of said subfields.

6. A plasma display panel driving method according to claim 1, wherein:

the number of said subfields constituting one field is N, and said sustain discharge is generated only in said light emission sustain stage in each of said n successive subfields (n is an integer from 0 to N) from the beginning of one field to display intermediate luminance at N+1 gradation levels.

* * * * *